US011200853B2

(12) United States Patent
Hwang et al.

(10) Patent No.: US 11,200,853 B2
(45) Date of Patent: Dec. 14, 2021

(54) DATA DRIVER AND DISPLAY DEVICE INCLUDING A DATA DRIVER

(71) Applicants: Samsung Display Co., Ltd., Yongin-Si (KR); Korea University Research and Business Foundation, Seoul (KR)

(72) Inventors: Young-Soo Hwang, Hwaseong-si (KR); Joon-Chul Goh, Suwon-si (KR); Oh Jo Kwon, Suwon-si (KR); Ki-Duk Kim, Daejeon (KR); Jeongmin Kim, Seoul (KR); Bong Hyun You, Seoul (KR); Hyung-Min Lee, Seoul (KR); Seung Hun Choi, Gunpo-si (KR)

(73) Assignees: Samsung Display Co., Ltd.; Korea University Research and Business Foundation

( * ) Notice: Subject to any disclaimer, the term of this patent is extended or adjusted under 35 U.S.C. 154(b) by 0 days.

(21) Appl. No.: 17/232,061

(22) Filed: Apr. 15, 2021

(65) Prior Publication Data

US 2021/0335277 A1 Oct. 28, 2021

(30) Foreign Application Priority Data

Apr. 28, 2020 (KR) ..... 10-2020-0051555

(51) Int. Cl.
*G09G 3/3233* (2016.01)
*G09G 3/3275* (2016.01)

(52) U.S. Cl.
CPC ..... *G09G 3/3275* (2013.01); *G09G 3/3233* (2013.01); *G09G 2310/027* (2013.01);
(Continued)

(58) Field of Classification Search
None
See application file for complete search history.

(56) References Cited

U.S. PATENT DOCUMENTS

2003/0025660 A1 2/2003 Miyazawa et al.
2010/0225518 A1 9/2010 Tokunaga et al.
(Continued)

FOREIGN PATENT DOCUMENTS

KR 10-0633537 B1 10/2006
KR 10-0670137 B1 1/2007
(Continued)

*Primary Examiner* — Michael A Faragalla
(74) *Attorney, Agent, or Firm* — Innovation Counsel LLP

(57) ABSTRACT

A data driver includes a gamma voltage generator configured to generate gamma voltages based on a number of data bits of a pixel data; a first digital-to-analog block configured to generate a plurality of time-division gamma voltage signals respectively corresponding to a plurality of gamma voltage groups; a plurality of time-division gamma voltage line groups for transferring the plurality of time-division gamma voltage signals; a second digital-to-analog block configured to select a time-division gamma voltage signal among the time-division gamma voltage signals according to upper bits of the pixel data in each channel; a time-division gamma voltage select block configured to select a gamma voltage according to lower bits of the pixel data in each channel; and an output buffer block configured to output the selected gamma voltage in each channel.

20 Claims, 17 Drawing Sheets

(52) U.S. Cl.
CPC ..... *G09G 2310/0286* (2013.01); *G09G 2310/0291* (2013.01); *G09G 2310/0294* (2013.01); *G09G 2310/08* (2013.01); *G09G 2320/0223* (2013.01); *G09G 2330/028* (2013.01)

(56) References Cited

U.S. PATENT DOCUMENTS

| | | | | |
|---|---|---|---|---|
| 2012/0206506 | A1 | 8/2012 | Kim et al. | |
| 2017/0098414 | A1* | 4/2017 | Yang ..... | G09G 3/3258 |
| 2017/0213495 | A1 | 7/2017 | Lee | |

FOREIGN PATENT DOCUMENTS

| | | | |
|---|---|---|---|
| KR | 10-0727410 | B1 | 6/2007 |
| KR | 10-2024064 | B1 | 9/2019 |

* cited by examiner

DATA DRIVER AND DISPLAY DEVICE INCLUDING A DATA DRIVER

CROSS-REFERENCE TO RELATED APPLICATION(S)

This application claims priority under 35 USC § 119 to Korean Patent Application No. 10-2020-0051555, filed on Apr. 28, 2020 in the Korean Intellectual Property Office (KIPO), the disclosure of which is incorporated by reference in its entirety.

BACKGROUND

1. Field

Embodiments of the present inventive concept relate to a display device, and more particularly to a data driver and a display device including the data driver.

2. Description of the Related Art

A data driver of a display device may receive a plurality of pixel data and may output a plurality of data voltages corresponding to the plurality of pixel data to a plurality of pixels through a plurality of channels. In doing so, the data driver may generate and provide a plurality of gamma voltages to each channel through a plurality of gamma voltage lines, select one of the plurality of gamma voltages according to pixel data for each channel, and output a selected gamma voltage as the data voltage for each channel. The number of the plurality of gamma voltage lines corresponding to the number of the plurality of gamma voltages may increase the size of the data driver. For example, as a bit number of each pixel data increases by 1, the number of the gamma voltage lines may be doubled, and the size of the data driver may be increased accordingly.

SUMMARY

Some embodiments of the present disclosure provide a data driver having a reduced size.

Some embodiments of the present disclosure provide a display device including a data driver having a reduced size.

According to an embodiment, a data driver outputs a plurality of data voltages to a plurality of pixels through a plurality of channels. The data driver includes a gamma voltage generator configured to generate $2^N$ gamma voltages, where N is an integer greater than one corresponding to a number of data bits of each pixel data among a plurality of pixel data received by the data driver; a first digital-to-analog block configured to group the $2^N$ gamma voltages into $2^{N-M}$ gamma voltage groups such that each gamma voltage group of the $2^{N-M}$ gamma voltage groups includes $2^M$ gamma voltages among the $2^N$ gamma voltages, where M is an integer greater than zero and less than N, and to generate $2^{N-M}$ time-division gamma voltage signals respectively corresponding to the $2^{N-M}$ gamma voltage groups, each time-division gamma voltage signal of the $2^{N-M}$ time-division gamma voltage signals representing the $2^M$ gamma voltages by dividing one horizontal time; $2^{N-M}$ time-division gamma voltage line groups for transferring the $2^{N-M}$ time-division gamma voltage signals, each time-division gamma voltage line group of the $2^{N-M}$ time-division gamma voltage line groups including K time-division gamma voltage lines, where K is greater than one and less than or equal to a number of the plurality of channels; a second digital-to-analog block configured to receive the $2^{N-M}$ time-division gamma voltage signals through the $2^{N-M}$ time-division gamma voltage line groups, and to select a time-division gamma voltage signal among the $2^{N-M}$ time-division gamma voltage signals according to upper (N−M) bits of the N bits of a corresponding one of the plurality of pixel data in each of the plurality of channels; a time-division gamma voltage select block configured to select one gamma voltage among the $2^M$ gamma voltages represented by the time-division gamma voltage signal selected by the second digital-to-analog block according to lower M bits of the N bits of the corresponding one of the plurality of pixel data in each of the plurality of channels; and an output buffer block configured to output, as a data voltage among the plurality of data voltages, the gamma voltage in each of the plurality of channels.

In embodiments, the plurality of channels may be grouped into K channel groups, and the K time-division gamma voltage lines may be respectively coupled to the K channel groups.

In embodiments, the plurality of channels may include K*L channels, where L is an integer greater than zero, the K*L channels may be grouped into K channel groups such that an (K*I+J)-th channel of the K*L channels is grouped into a J-th channel group of the K channel groups, where I is an integer greater than or equal to zero and less than L, and J is an integer greater than zero and less than or equal to K, and the K time-division gamma voltage lines may be respectively coupled to the K channel groups such that each of the K time-division gamma voltage lines is coupled to L channels of the K*L channels.

In embodiments, the K time-division gamma voltage lines may be four time-division gamma voltage lines, the plurality of channels may include 4*L channels, where L is an integer greater than zero, the 4*L channels may be grouped into four channel groups such that an (4*I+J)-th channel of the 4*L channels is grouped into a J-th channel group of the four channel groups, where I is an integer greater than or equal to zero and less than L, and J is an integer greater than zero and less than or equal to four, and the four time-division gamma voltage lines may be respectively coupled to the four channel groups such that each of the four time-division gamma voltage lines is coupled to corresponding L of the 4*L channels.

In embodiments, the plurality of channels may include K*L channels, where L is an integer greater than zero, the K*L channels may be grouped into K channel groups such that consecutive L channels of the K*L channels are grouped into a channel group among the K channel groups, and the K time-division gamma voltage lines may be respectively coupled to the K channel groups such that each of the K time-division gamma voltage lines is coupled to the consecutive L channels of the K*L channels.

In embodiments, the K time-division gamma voltage lines may be four time-division gamma voltage lines, the plurality of channels may include 4*L channels, where L is an integer greater than zero, first through L-th channels of the 4*L channels may be grouped into a first channel group, (L+1)-th through 2L-th channels of the 4*L channels may be grouped into a second channel group, (2L+1)-th through 3L-th channels of the 4*L channels may be grouped into a third channel group, (3L+1)-th through 4L-th channels of the 4*L channels may be grouped into a fourth channel group, and the four time-division gamma voltage lines may be respectively coupled to the first channel group, the second channel group, the third channel group, and the fourth channel group such that each of the four time-division gamma voltage lines is coupled to L channels of the 4*L channels.

In embodiments, the one horizontal time may be equally divided into $2^M$ divided times having a same time period, and each time-division gamma voltage signal may represent the $2^M$ gamma voltages having non-linear voltage intervals in the $2^M$ divided times, respectively.

In embodiments, the one horizontal time may be equally divided into $2^M$ divided times having a same time period, and each time-division gamma voltage signal may represent the $2^M$ gamma voltages having a same voltage interval in the $2^M$ divided times, respectively.

In embodiments, the one horizontal time may be divided into $2^M$ divided times having different time periods, and each time-division gamma voltage signal may represent the $2^M$ gamma voltages having a same voltage interval in the $2^M$ divided times, respectively.

In embodiments, the gamma voltage generator may include $2^N+1$ resistors coupled in series between a first line of a high voltage and a second line of a low voltage, and configured to generate the $2^N$ gamma voltages by dividing a voltage between the high voltage and the low voltage.

In embodiments, the $2^N$ gamma voltages generated by the gamma voltage generator may be gradually decreased from a first gamma voltage to a $(2^N)$-th gamma voltage.

In embodiments, the $2^N$ gamma voltages generated by the gamma voltage generator may be gradually increased from a first gamma voltage to a $(2^N)$-th gamma voltage.

In embodiments, a first voltage interval between the $2^N$ gamma voltages in a low gray region may be less than a second voltage interval between the $2^N$ gamma voltages in a high gray region.

In embodiments, the first digital-to-analog block may include a clock generator configured to generate a clock signal having $2^M$ clocks during the one horizontal time, a bit counter configured to generate a count signal representing one to $2^M$ in response to the clock signal, and $2^{N-M}$ M-bit digital-to-analog converters configured to output the $2^{N-M}$ time-division gamma voltage signals, respectively, each M-bit digital-to-analog converter of the $2^{N-M}$ M-bit digital-to-analog converters configured to sequentially output, as a time-division gamma voltage signal of the $2^{N-M}$ time-division gamma voltage signals, the $2^M$ gamma voltages in response to the count signal.

In embodiments, the second digital-to-analog block may include a plurality of (N−M)-bit digital-to-analog converters respectively corresponding to the plurality of channels, each (N−M)-bit digital-to-analog converter of the plurality of (N−M)-bit digital-to-analog converters configured to select the time-division gamma voltage signal among the $2^{N-M}$ time-division gamma voltage signals according to the upper (N−M) bits of the corresponding one of the plurality of pixel data.

In embodiments, each of the plurality of (N−M)-bit digital-to-analog converters may include a decoder configured to generate $2^{N-M}$ switching signals based on the upper (N−M) bits of the corresponding one of the plurality of pixel data, and $2^{N-M}$ switches configured to selectively output the $2^{N-M}$ time-division gamma voltage signals in response to the $2^{N-M}$ switching signals.

In embodiments, the time-division gamma voltage select block may include a plurality of switching signal generators respectively corresponding to the plurality of channels, each switching signal generator of the plurality of switching signal generators configured to generate a time-division switching signal having an active level during a divided time corresponding to the lower M bits of the corresponding one of the plurality of pixel data among $2^M$ divided times of the one horizontal time, and a plurality of time-division gamma voltage select switches respectively corresponding to the plurality of channels, each time-division gamma voltage select switch of the plurality of time-division gamma voltage select switches configured to select the gamma voltage among the $2^M$ gamma voltages in response to the time-division switching signal having the active level.

In embodiments, the data driver may further include a shift register block configured to sequentially generate sampling signals in response to a start signal and a clock signal, a sampling latch block configured to sequentially sample the plurality of pixel data in response to the sampling signals, and a holding latch block configured to store the plurality of pixel data sampled by the sampling latch block in response to a load signal.

In embodiments, the upper (N−M) bits of the N bits of each of the plurality of pixel data that is output from the holding latch block may be provided to the second digital-to-analog block, and the lower M bits of the N bits of each of the plurality of pixel data that is output from the holding latch block may be provided to the time-division gamma voltage select block.

According to an embodiment, a display device includes a display panel including a plurality of pixels; a data driver configured to receive a plurality of pixel data each having N bits, and to output a plurality of data voltages corresponding to the plurality of pixel data to the plurality of pixels through a plurality of channels, where N is an integer greater than one; and a controller configured to provide the plurality of pixel data to the data driver. The data driver includes a gamma voltage generator configured to generate $2^N$ gamma voltages; a first digital-to-analog block configured to group the $2^N$ gamma voltages into $2^{N-M}$ gamma voltage groups such that each gamma voltage group of the $2^{N-M}$ gamma voltage groups includes $2^M$ gamma voltages among the $2^N$ gamma voltages, where M is an integer greater than zero and less than N, and to generate $2^{N-M}$ time-division gamma voltage signals respectively corresponding to the $2^{N-M}$ gamma voltage groups, each time-division gamma voltage signal of the $2^{N-M}$ time-division gamma voltage signals representing the $2^M$ gamma voltages by dividing one horizontal time; $2^{N-M}$ time-division gamma voltage line groups for transferring the $2^{N-M}$ time-division gamma voltage signals, each time-division gamma voltage line group of the $2^{N-M}$ time-division gamma voltage line groups including K time-division gamma voltage lines, where K is greater than one and less than or equal to a number of the plurality of channels; a second digital-to-analog block configured to receive the $2^{N-M}$ time-division gamma voltage signals through the $2^{N-M}$ time-division gamma voltage line groups, and to select a time-division gamma voltage signal among the $2^{N-M}$ time-division gamma voltage signals according to upper (N−M) bits of the N bits of a corresponding one of the plurality of pixel data in each of the plurality of channels; a time-division gamma voltage select block configured to select a gamma voltage among the $2^M$ gamma voltages represented by the time-division gamma voltage signal selected by the second digital-to-analog block according to lower M bits of the N bits of the corresponding one of the plurality of pixel data in each of the plurality of channels; and an output buffer block configured to output, as a data voltage among the plurality of data voltages, the gamma voltage in each of the plurality of channels.

As described above, in a data driver and a display device according to an embodiment, the first digital-to-analog block may generate the $2^{N-M}$ time-division gamma voltage signals, the second digital-to-analog block may select one of the $2^{N-M}$ time-division gamma voltage signals according to the upper (N−M) bits of each pixel data in each channel, and the time-division gamma voltage select block may select one of $2^{M}$ gamma voltages represented by a selected time-division gamma voltage signal according to the lower M bits of each pixel data in each channel. Accordingly, a size and power consumption of the data driver may be reduced.

Further, in a data driver and a display device according to an embodiment, each time-division gamma voltage signal may be transferred to the plurality of channels through the K time-division gamma voltage lines, where K is greater than one and less than or equal to the number of the plurality of channels, and each time-division gamma voltage line may be coupled to only a corresponding portion of the plurality of channels. Accordingly, a delay (e.g., an RC delay) of the time-division gamma voltage signals may be reduced, and the time-division gamma voltage signal may be accurately transferred to the plurality of channels.

BRIEF DESCRIPTION OF THE DRAWINGS

Illustrative, non-limiting embodiments of the present disclosure will be more clearly understood from the following detailed description in conjunction with the accompanying drawings.

DESCRIPTION OF EMBODIMENTS

Figure 1:
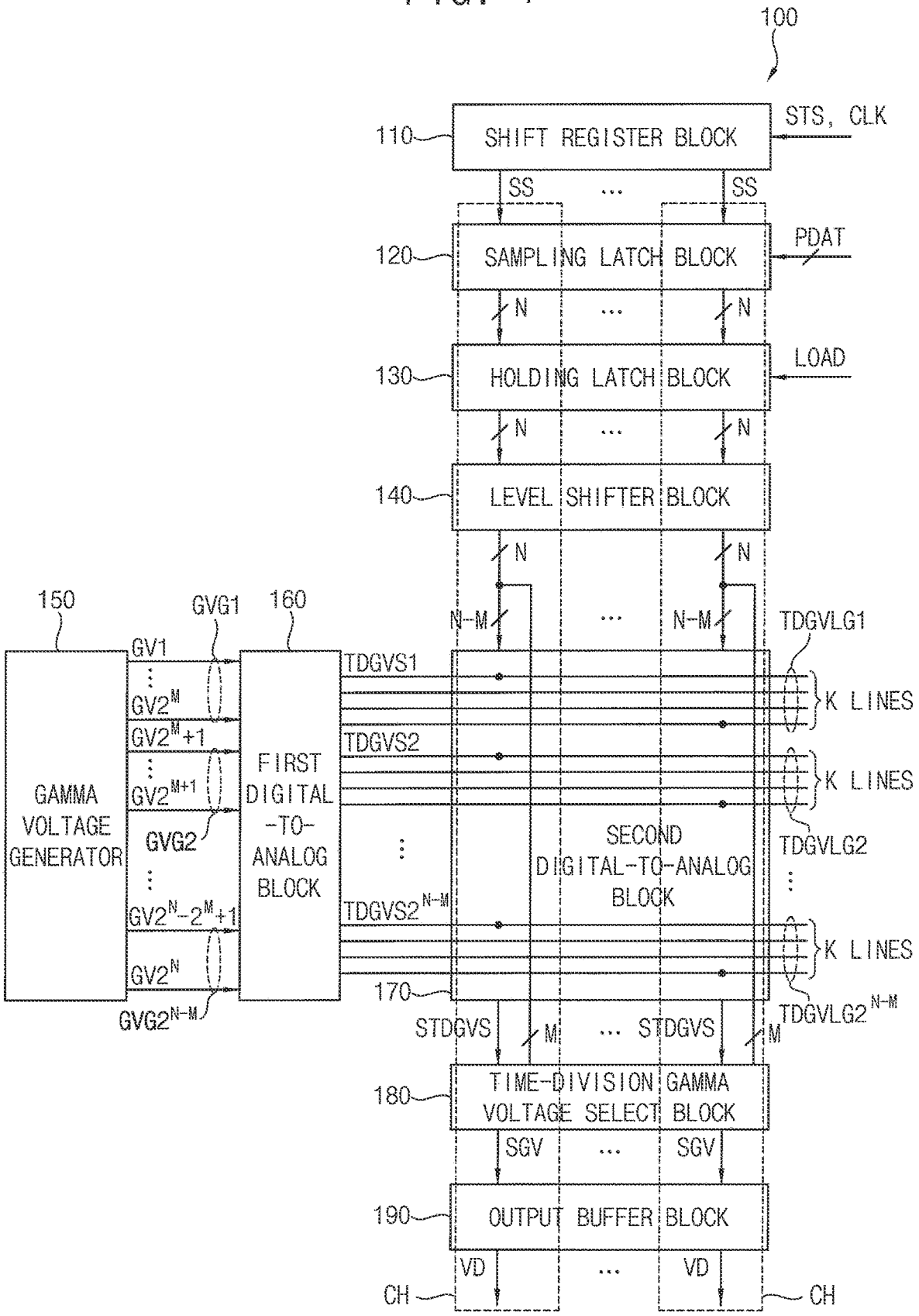
FIG. 1 is a block diagram of a data driver according to an embodiment.

The embodiments of the present disclosure are described more fully hereinafter with reference to the accompanying drawings. Like or similar reference numerals refer to like or similar elements throughout the present disclosure.

Figure 2:
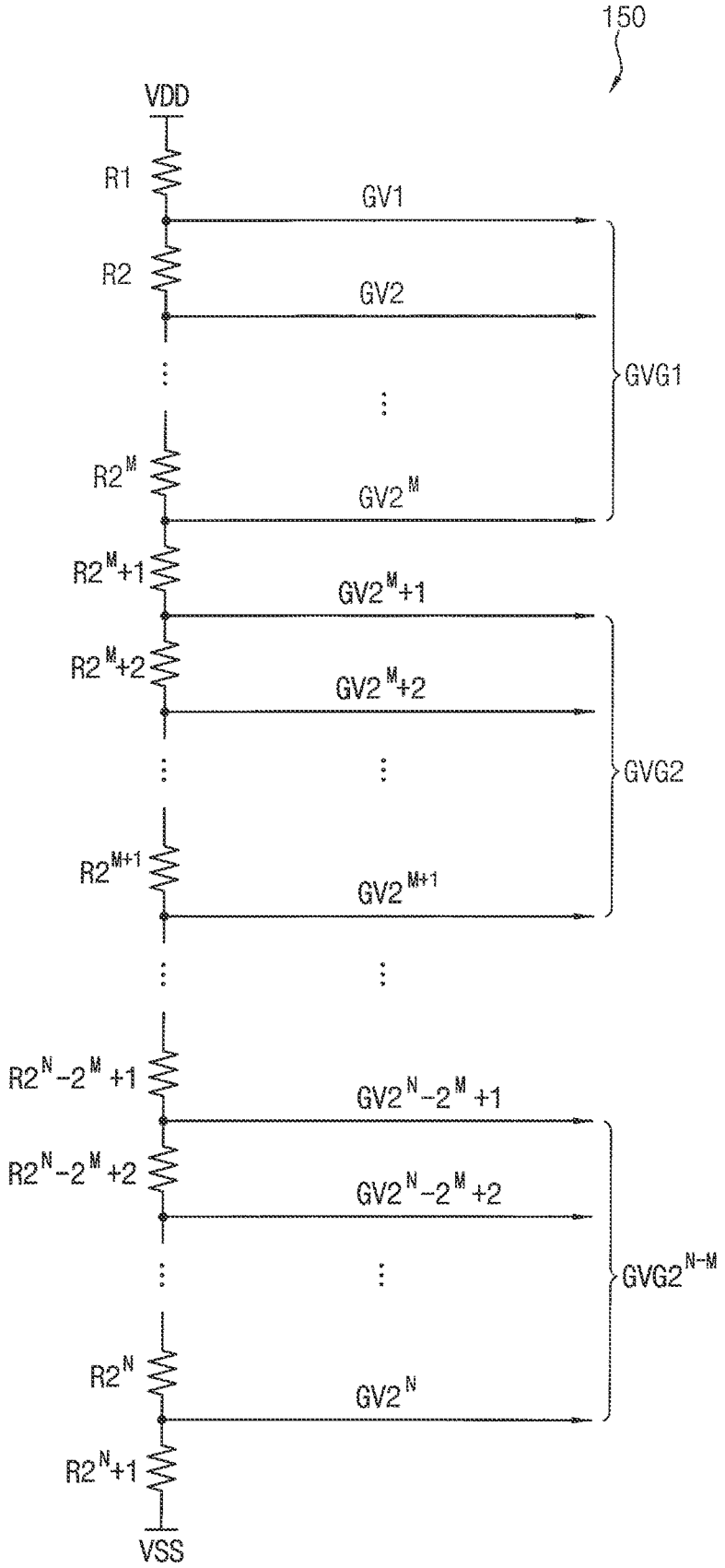
FIG. 2 is a circuit diagram of a gamma voltage generator included in a data driver according to an embodiment.
Figure 3:
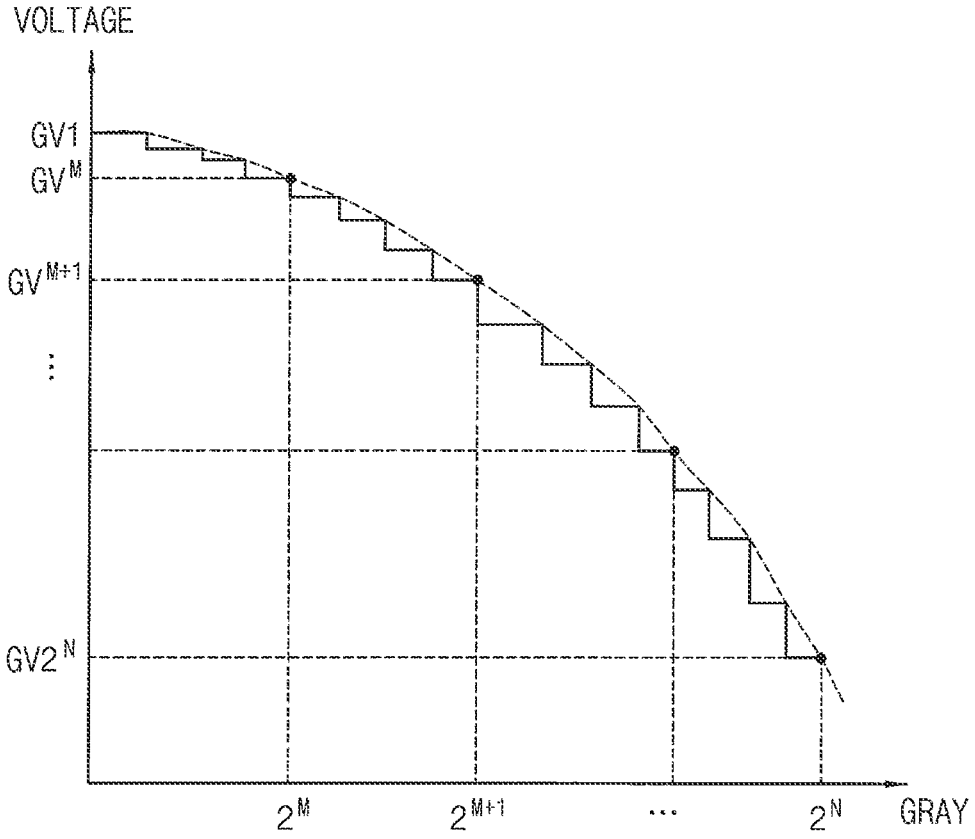
FIG. 3 illustrates an example of gamma voltages generated by a gamma voltage generator according to an embodiment.
Figure 4:
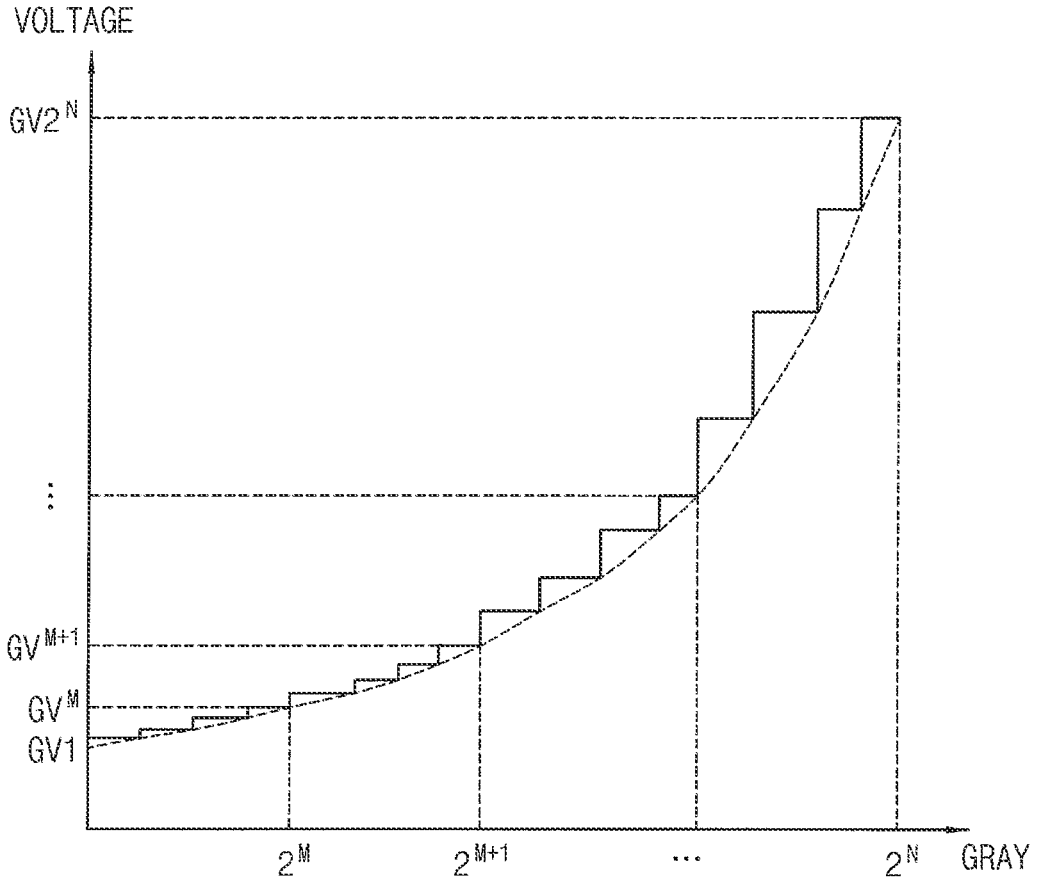
FIG. 4 illustrates another example of gamma voltages generated by a gamma voltage generator according to an embodiment.
Figure 5:
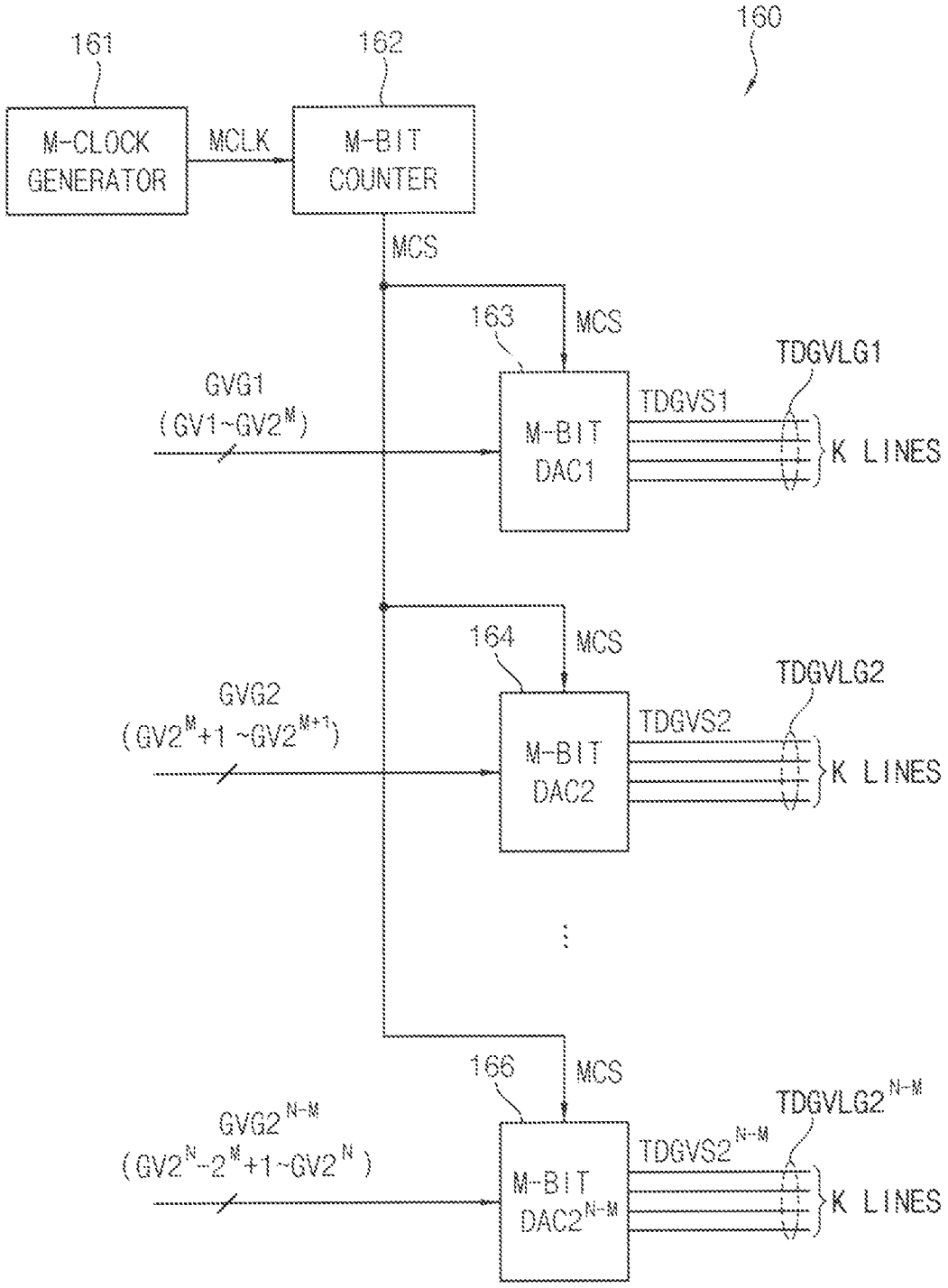
FIG. 5 is a block diagram of a first digital-to-analog block included in a data driver according to an embodiment.
Figure 6:
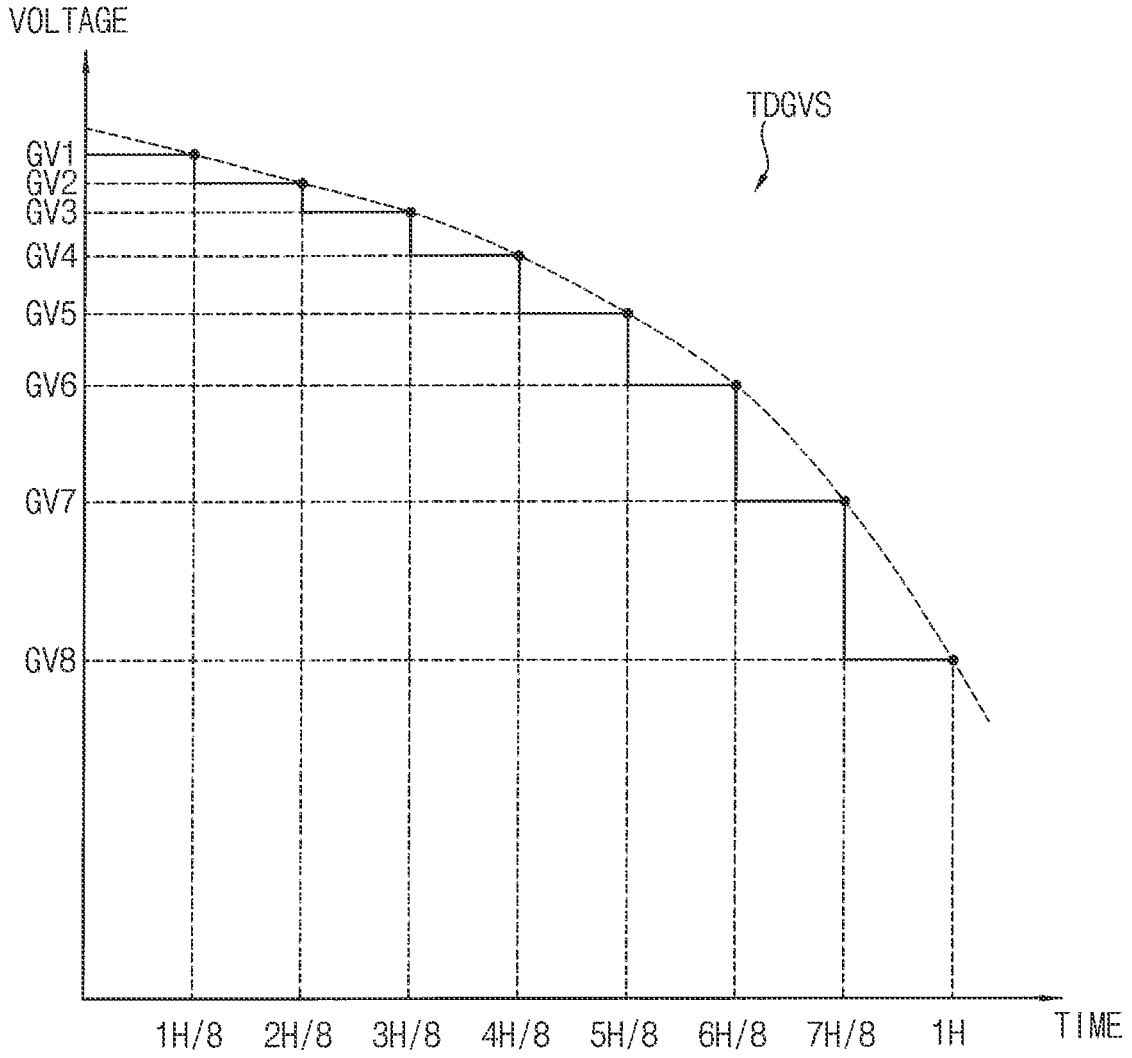
FIG. 6 illustrates an example of a time-division gamma voltage signal output by each M-bit digital-to-analog converter of a first digital-to-analog block.
Figure 7:
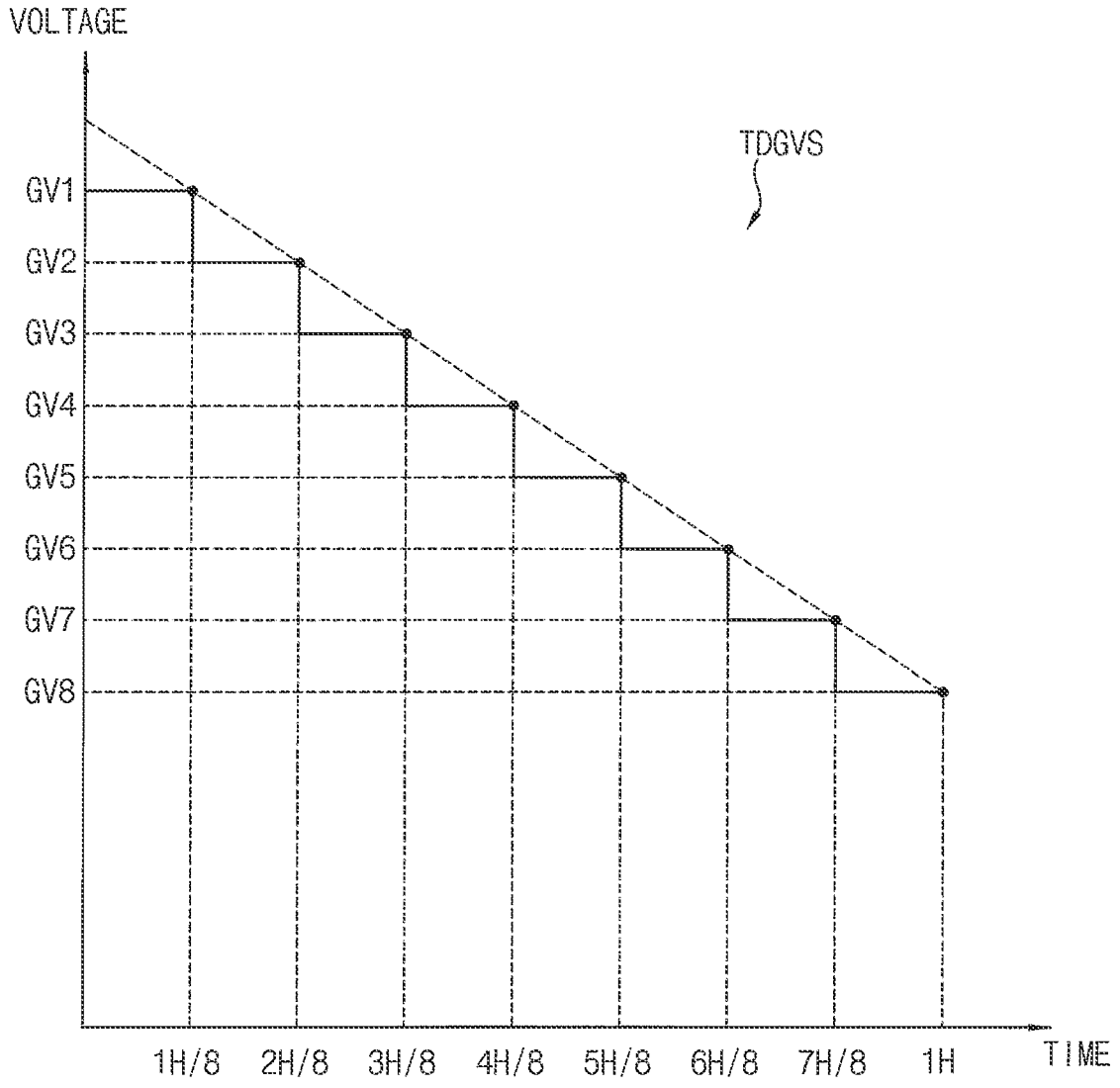
FIG. 7 illustrates another example of a time-division gamma voltage signal output by each M-bit digital-to-analog converter of a first digital-to-analog block.
Figure 8:
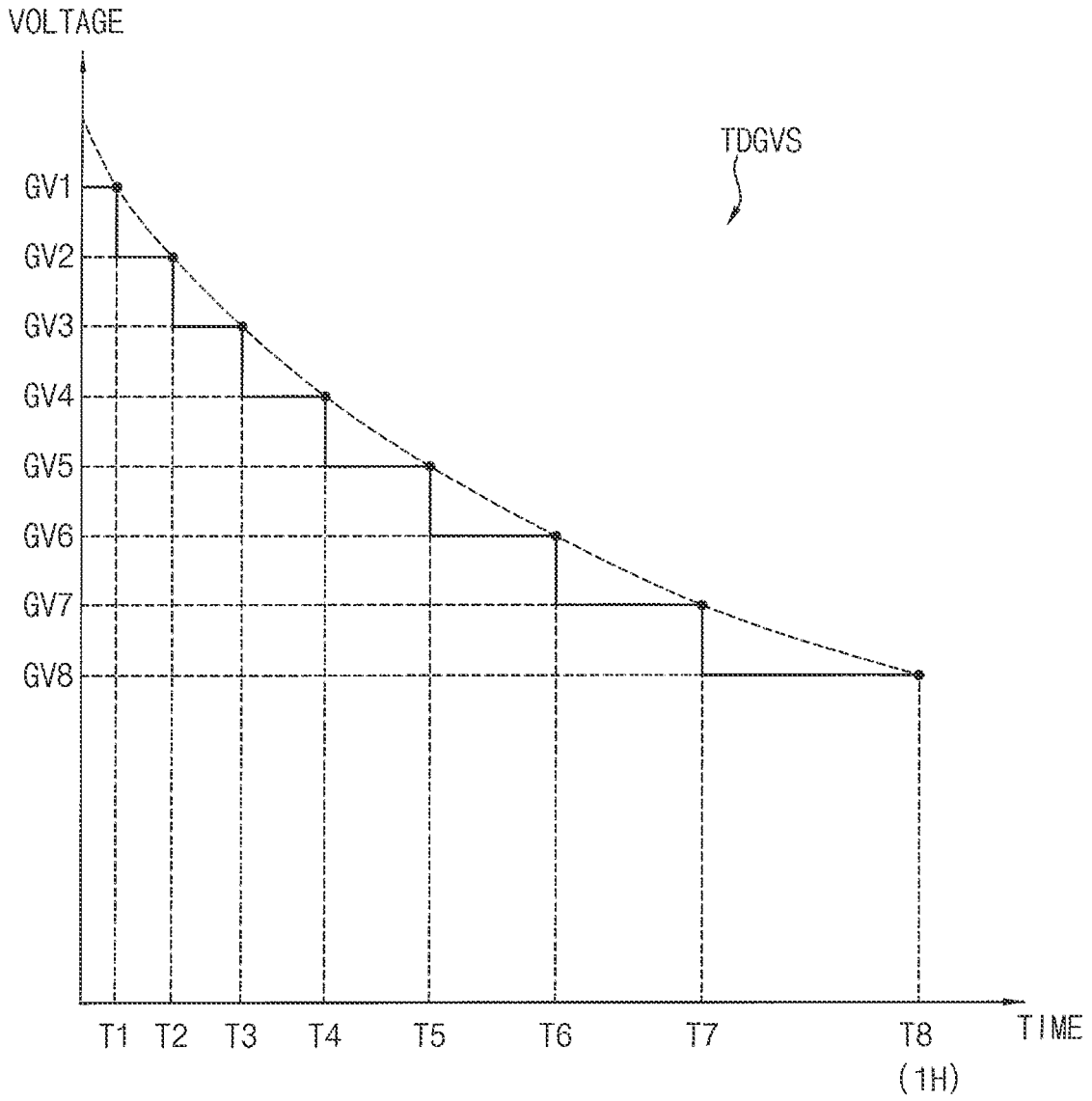
FIG. 8 illustrates still another example of a time-division gamma voltage signal output by each M-bit digital-to-analog converter of a first digital-to-analog block.
Figure 9:
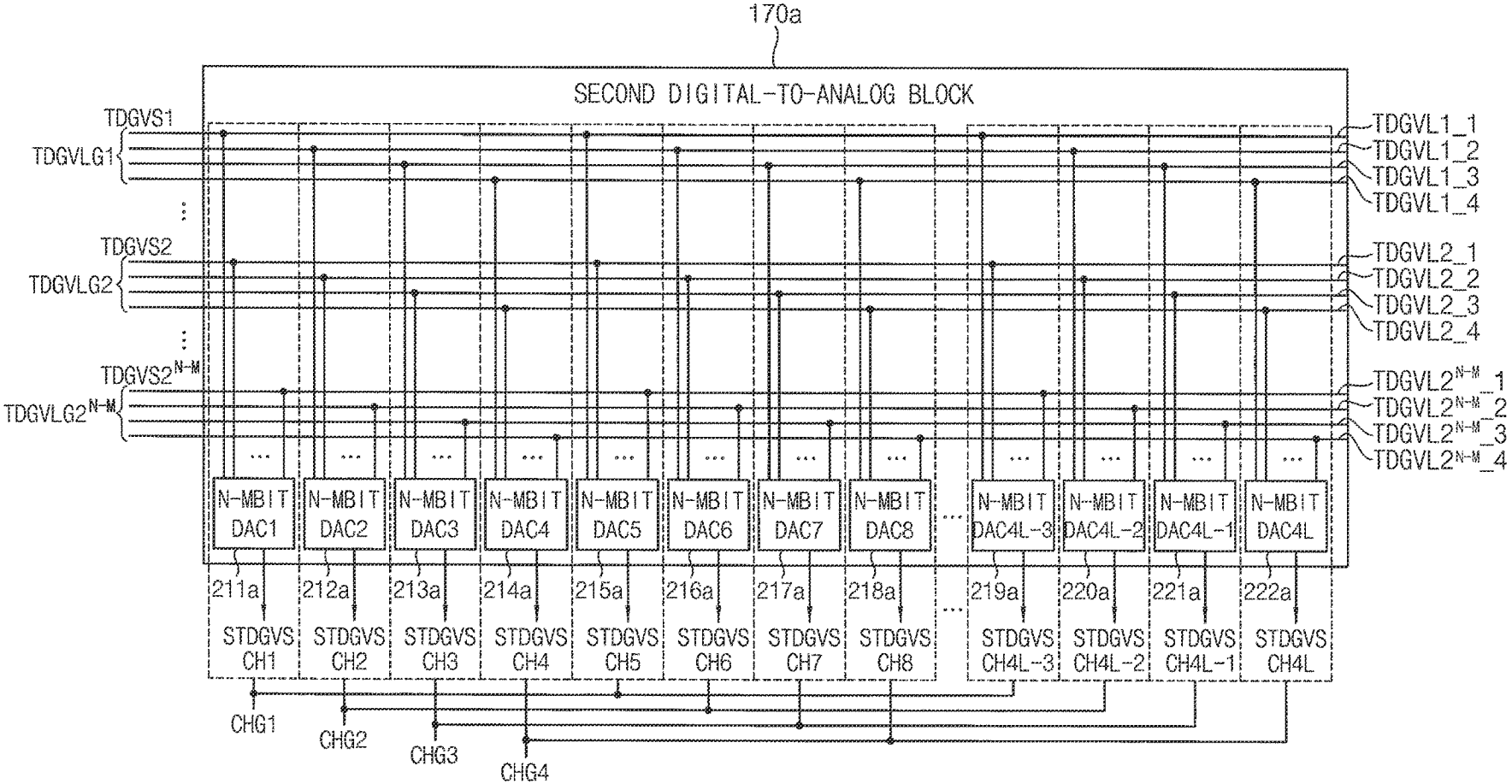
FIG. 9 is a block diagram of a data driver including a plurality of time-division gamma voltage line groups coupled to a plurality of channels according to an embodiment.
Figure 10:
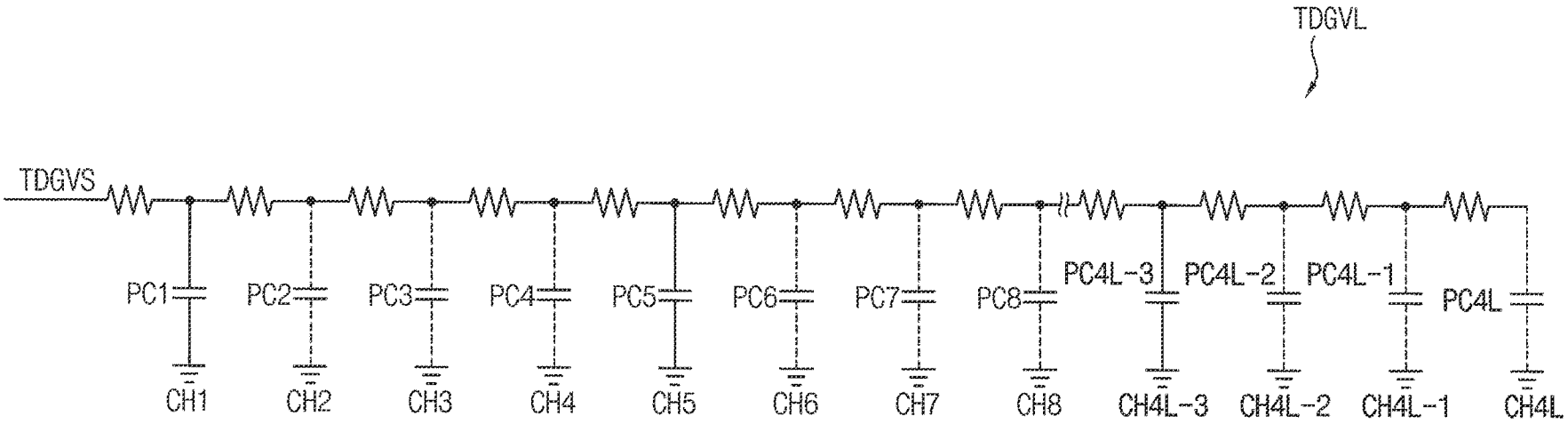
FIG. 10 is a circuit diagram of a time-division gamma voltage line for describing an example of a delay of a time-division gamma voltage signal.
Figure 11:
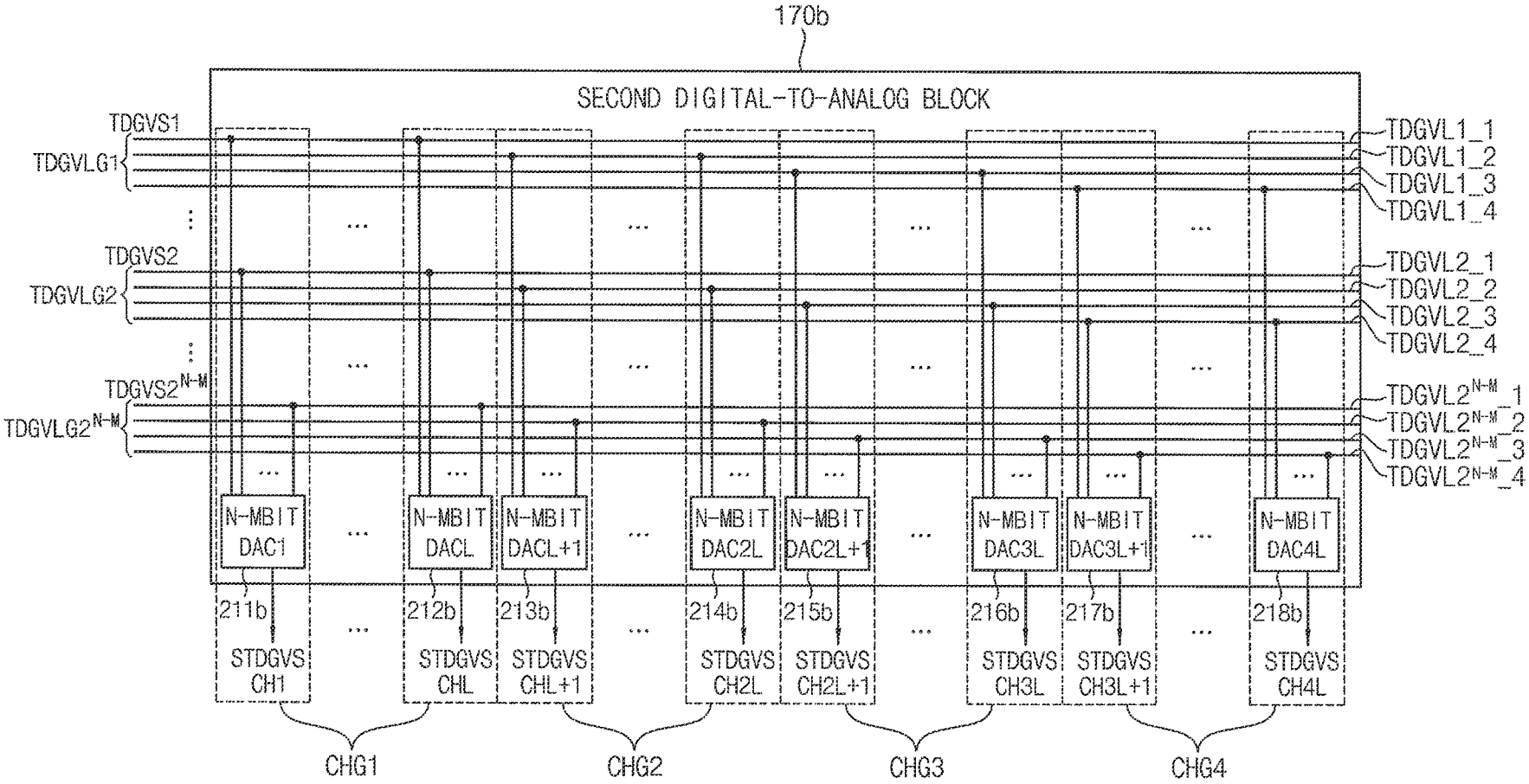
FIG. 11 is a block diagram of a data driver including a plurality of time-division gamma voltage line groups coupled to a plurality of channels according to another embodiment.
Figure 12:
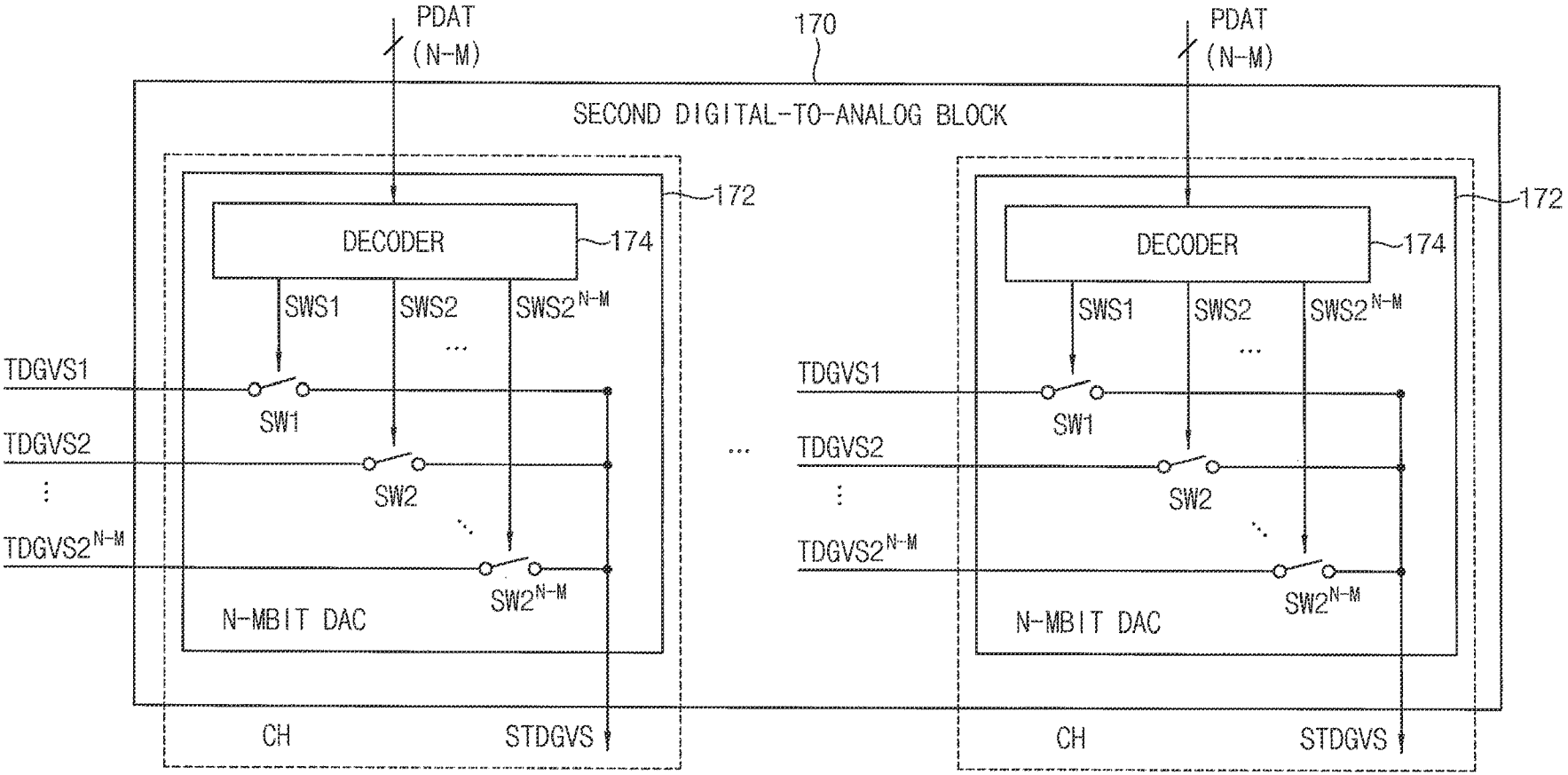
FIG. 12 is a block diagram of a second digital-to-analog block included in a data driver according to an embodiment.
Figure 13:
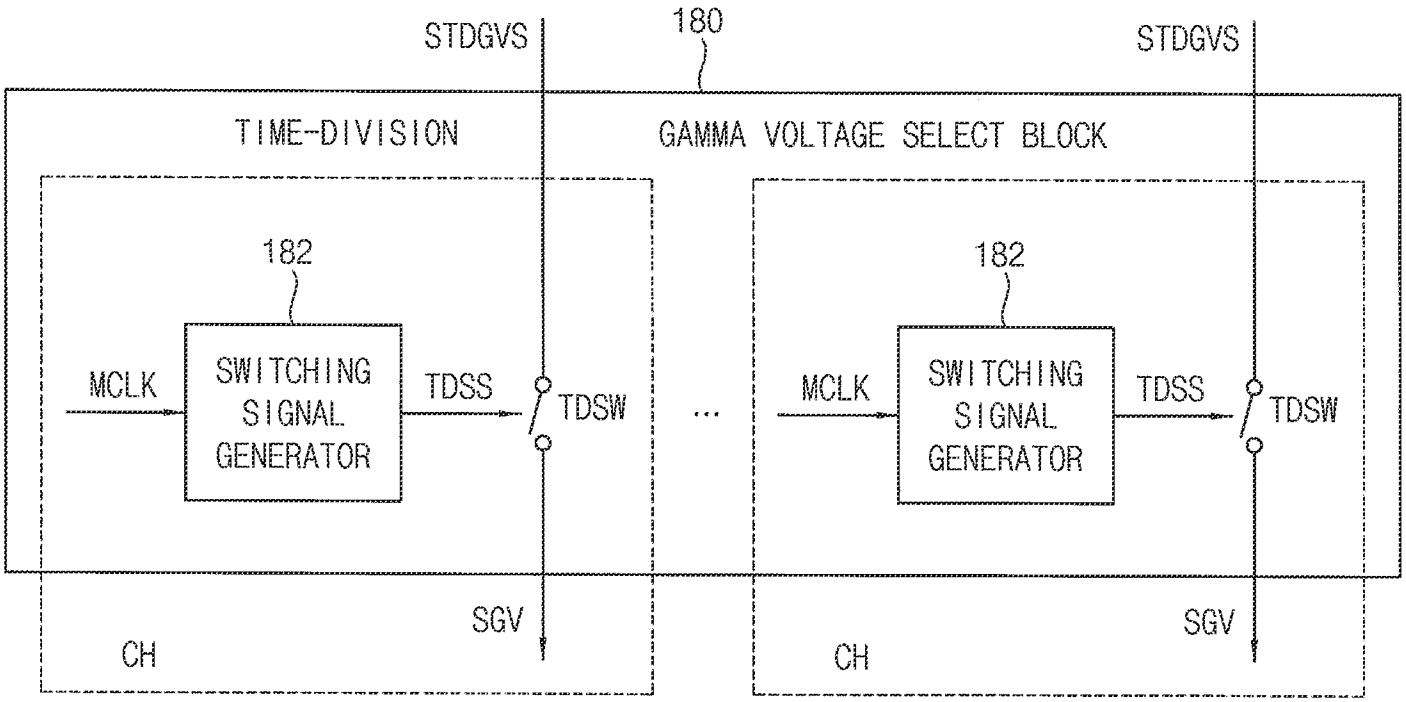
FIG. 13 is a block diagram of a time-division gamma voltage select block included in a data driver according to an embodiment.
Figure 14:
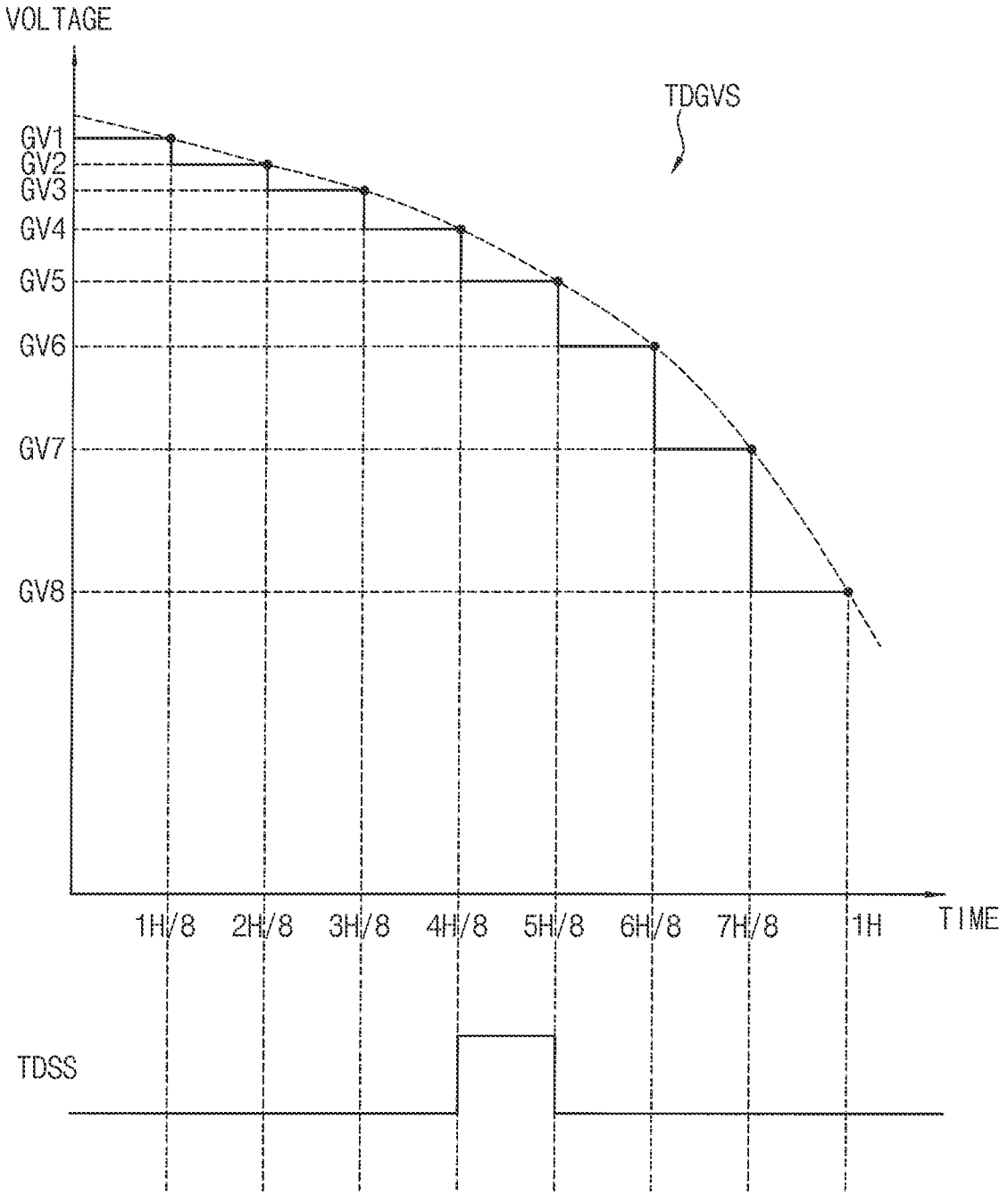
FIG. 14 illustrates an example of an operation of a time-division gamma voltage select block of FIG. 13.

FIG. 1 is a block diagram of a data driver according to an embodiment, FIG. 2 is a circuit diagram of a gamma voltage generator included in a data driver according to an embodiment, FIG. 3 illustrates an example of gamma voltages generated by a gamma voltage generator according to an embodiment, FIG. 4 illustrates another example of gamma voltages generated by a gamma voltage generator according to an embodiment, FIG. 5 is a block diagram of a first digital-to-analog block included in a data driver according to an embodiment, FIG. 6 illustrates an example of a time-division gamma voltage signal output by each M-bit digital-to-analog converter of a first digital-to-analog block, FIG. 7 illustrates another example of a time-division gamma voltage signal output by each M-bit digital-to-analog converter of a first digital-to-analog block, FIG. 8 illustrates still another example of a time-division gamma voltage signal output by each M-bit digital-to-analog converter of a first digital-to-analog block, FIG. 9 is a block diagram of a data driver including a plurality of time-division gamma voltage line groups coupled to a plurality of channels according to an embodiment, FIG. 10 is a circuit diagram of a time-division gamma voltage line for describing an example of a delay of a time-division gamma voltage signal, FIG. 11 is a block diagram of a data driver including a plurality of time-division gamma voltage line groups coupled to a plurality of channels in a data driver according to another embodiment, FIG. 12 is a block diagram of a second digital-to-analog block included in a data driver according to an embodiment, FIG. 13 is a block diagram of a time-division gamma voltage select block included in a data driver according to an embodiment, and FIG. 14 illustrates an example of an operation of a time-division gamma voltage select block of FIG. 13.

Referring to FIG. 1, a data driver 100 may receive a plurality of pixel data PDAT, and may output a plurality of data voltages VD corresponding to the plurality of pixel data PDAT to a plurality of pixels of a display panel through a plurality of channels CH. The data driver 100 may include a gamma voltage generator 150, a first digital-to-analog block 160, $2^{N-M}$ time-division gamma voltage line groups TDGVLG1 through TDGVLG$\mathbf{2}^{N-M}$, a second digital-to-analog block 170, a time-division gamma voltage select block 180, and an output buffer block 190. In some embodiments, the data driver 100 may further include a shift register block 110, a sampling latch block 120, a holding latch block 130, and a level shifter block 140.

The shift register block 110 may sequentially generate sampling signals SS in response to a start signal STS and a clock signal CLK. In some embodiments, the shift register block 110 may include a plurality of serially connected shift registers that sequentially outputs the sampling signals SS by shifting the start signal STS in response to the clock signal CLK.

The sampling latch block 120 may sequentially sample output image data ODAT from a controller (e.g., controller 440 in FIG. 15) or the plurality of pixel data PDAT for the plurality of pixels in response to the sampling signals SS received from the shift register block 110. In some embodiments, the sampling latch block 120 may include a plurality of sampling latches that respectively samples the plurality of pixel data PDAT in response to the sampling signals SS.

The holding latch block 130 may store the plurality of pixel data PDAT sampled by the sampling latch block 120 in response to a load signal LOAD. In some embodiments, the holding latch block 130 may include a plurality of holding latches that corresponds to the plurality of sampling latches of the sampling latch block 120.

The level shifter block 140 may change a voltage level of the plurality of pixel data PDAT that is output from the holding latch block 130 to a voltage level suitable for the second digital-to-analog block 170 and/or the time-division gamma voltage select block 180. In some embodiments, the level shifter block 140 may include a plurality of level shifters that corresponds to the plurality of holding latches of the holding latch block 130.

In some embodiments, each pixel data PDAT may have N bits, where N is an integer greater than 1. In each channel CH, upper (N−M) bits of the N bits of each pixel data PDAT that is output from the holding latch block 130 through the level shifter block 140 may be provided to the second digital-to-analog block 170, and lower M bits of the N bits of each pixel data PDAT that is output from the holding latch block 130 through the level shifter block 140 may be provided to the time-division gamma voltage select block 180, where M is an integer greater than 0 and less than N. For example, in a case where N is 10, and M is 4, the holding latch block 130 may provide the upper 6 bits of each pixel data PDAT to the second digital-to-analog block 170, and may provide the lower 4 bits of each pixel data PDAT to the time-division gamma voltage select block 180.

The gamma voltage generator 150 may generate $2^N$ gamma voltages corresponding to $2^N$ gray levels that can be represented by each pixel data PDAT having the N bits. In some embodiments, the gamma voltage generator 150 may receive gamma reference voltages having gamma reference gray levels that are a portion of the $2^N$ gray levels from the controller (not shown) or a gamma reference voltage generator (not shown), and may generate the $2^N$ gamma voltages respectively corresponding to the entire $2^N$ gray levels based on the gamma reference voltages.

Figure 16:
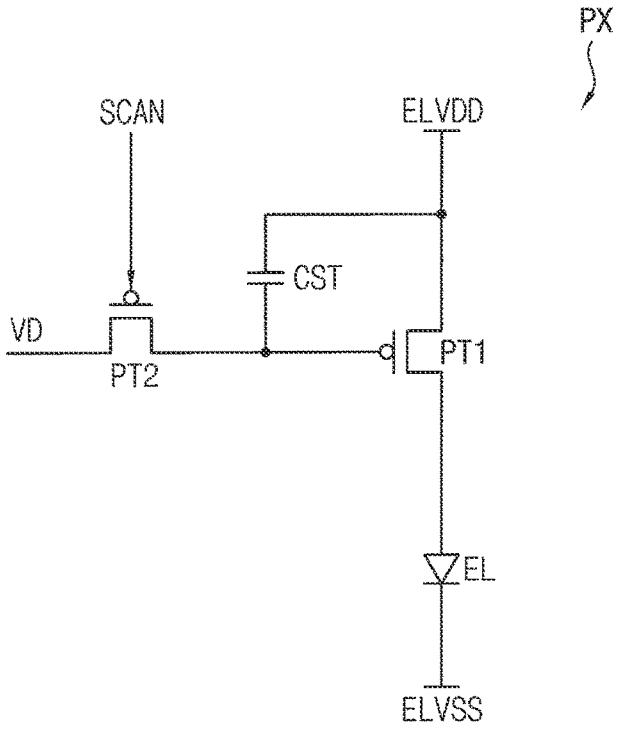
FIG. 16 is a circuit diagram of a pixel included in a display device according to an embodiment.
Figure 17:
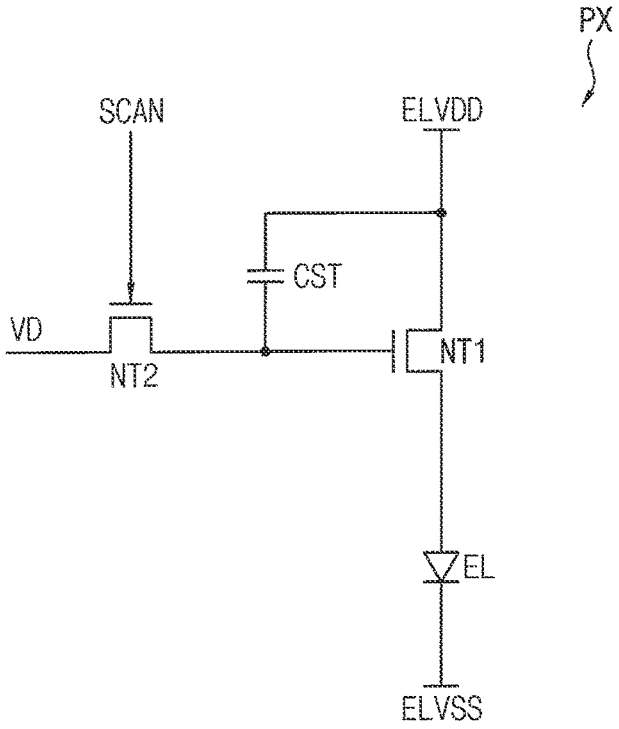
FIG. 17 is a circuit diagram of another example of a pixel included in a display device according to an embodiment.

In some embodiments, as illustrated in FIG. 2, the gamma voltage generator 150 may include $2^N+1$ resistors R1 through R$2^N+1$ that are coupled in series between a line of a high voltage VDD and a line of a low voltage VSS. The $2^N+1$ resistors R1 through R$2^N+1$ may generate the $2^N$ gamma voltages GV1 through GV$2^N$ by dividing the voltage between the high voltage VDD and the low voltage VSS. In some embodiments, as illustrated in FIG. 3, the $2^N$ gamma voltages GV1 through GV$2^N$ generated by the gamma voltage generator 150 may be gradually decreased from a first gamma voltage GV1 that corresponds to a first gray level (e.g., a 0-gray level) to a ($2^N$)-th gamma voltage GV$2^N$ that corresponds to a ($2^N$)-th gray level (e.g., in a case where N is 8, a 255-gray level). In other embodiments, as illustrated in FIG. 4, the $2^N$ gamma voltages GV1 through GV$2^N$ generated by the gamma voltage generator 150 may be gradually increased from the first gamma voltage GV1 that corresponds to the first gray level (e.g., the 0-gray level) to the ($2^N$)-th gamma voltage GV$2^N$ that corresponds to the ($2^N$)-th gray level (e.g., in a case where N is 8, the 255-gray level). For example, in a case where each pixel includes a driving transistor PT1 implemented with a P-type metal-oxide-semiconductor (PMOS) transistor as illustrated in FIG. 16, the gamma voltage generator 150 may generate (but not limited to) the $2^N$ gamma voltages GV1 through GV$2^N$ as illustrated in FIG. 3. In another example, in a case where each pixel includes a driving transistor NT1 implemented with an N-type metal-oxide-semiconductor (NMOS) transistor as illustrated in FIG. 17, the gamma voltage generator 150 may generate, but not limited to, the $2^N$ gamma voltages GV1 through GV$2^N$ as illustrated in FIG. 4. In still another example, regardless of the type of the driving transistor, the $2^N$ gamma voltages GV1 through GV$2^N$ that are generated by the gamma voltage generator 150 may be increased and/or decreased from the first gamma voltage GV1 to the ($2^N$)-th gamma voltage GV$2^N$. Further, in some embodiments, as illustrated in FIGS. 3 and 4, a voltage interval between the gamma voltages (e.g., the first gamma voltage GV1 to a ($2^M$)-th gamma voltage GV$2^M$) in a low gray region (e.g., from the first gray level to a ($2^M$)-th gray level) may be less than a voltage interval between the gamma voltages (e.g., a ($2^N-2^M+1$)-th gamma voltage through the ($2^N$)-th gamma voltage GV$2^N$) in a high gray region (e.g., from a ($2^N-2^M+1$)-th gray level to the ($2^N$)-th gray level). For example, the voltage interval between two adjacent ones of the $2^N$ gamma voltages GV1 through GV$2^N$ may be gradually increased as a gray level increases, or as the $2^N$ gamma voltages GV1 through GV$2^N$ increase the first gamma voltage GV1 to the ($2^N$)-th gamma voltage GV$2^N$. In this case, the $2^N$ gamma voltages GV1 through GV$2^N$ may have a relatively small voltage interval in the low gray region, therefore gray levels may be more accurately expressed in the low gray region.

Further, in some embodiments, as illustrated in FIG. 2, the $2^N$ gamma voltages GV1 through GV$2^N$ may be grouped (by the first digital-to-analog block 160) into $2^{N-M}$ gamma voltage groups GVG1 through GVG$2^{N-M}$ such that each gamma voltage group (e.g., GVG1) may respectively include $2^M$ gamma voltages (e.g., GV1 through GV$2^M$) among the $2^N$ gamma voltages GV1 through GV$2^N$. For example, in a case where N is 10, and M is 4, the first through sixteenth gamma voltages GV1 through GV16 may be grouped into a first gamma voltage group GVG1, the seventeenth through thirty second gamma voltages GV17 through GV32 may be grouped into a second gamma voltage group GVG2, and one thousand ninth through one thousand twenty fourth gamma voltages GV1009 through GV1024 may be grouped into a sixty-fourth gamma voltage group GVG64.

The first digital-to-analog block 160 may receive the $2^{N-M}$ gamma voltage groups GVG1 through GVG$2^{N-M}$, each (e.g., GVG1) including the $2^M$ gamma voltages (e.g., GV1 through GV$2^M$) from the gamma voltage generator 150, and may generate $2^{N-M}$ time-division gamma voltage signals TDGVS1 through TDGVS$2^{N-M}$ respectively corresponding to the $2^{N-M}$ gamma voltage groups GVG1 through GVG$2^{N-M}$. Each time-division gamma voltage signal TDGVS (e.g., TDGVS1) may represent the $2^M$ gamma voltages (e.g., GV1 through GV$2^M$) by dividing one horizontal time 1H. The one horizontal time 1H indicates a time in which one row of pixels is processed.

In some embodiments, as illustrated in FIG. 5, the first digital-to-analog block 160 may include an M-clock generator 161, an M-bit counter 162, and $2^{N-M}$ M-bit digital-to-analog converters (DACs) 163, 164, . . . , and 166. The M-clock generator 161 may generate an M-clock signal MCLK having $2^M$ clocks during the one horizontal time. The M-bit counter 162 may to generate an M-count signal MCS representing values increasing from 1 to $2^M$ during the one horizontal time by counting the clocks of the M-clock signal MCLK. The $2^{N-M}$ M-bit DACs 163, 164, . . . , 166 may respectively output the $2^{N-M}$ time-division gamma voltage signals TDGVS1 through TDGVS2$^{N-M}$. Each M-bit DAC (e.g., 163) may receive a corresponding gamma voltage group (e.g., GVG1), or the $2^M$ gamma voltages (e.g., GV1 through GV2$^M$), and may sequentially output the $2^M$ gamma voltages (e.g., GV1 through GV2$^M$) in response to the M-count signal MCS as a corresponding time-division gamma voltage signal TDVGS (e.g., TDGVS1) among the $2^{N-M}$ time-division gamma voltage signals TDGVS1 through TDGVS2$^{N-M}$. In a case where M is 3, for example, as illustrated in FIG. 6, the one horizontal time 1H may be equally divided into $2^M$ (or 8) divided times having the same time period of 1H/8, and each time-division gamma voltage signal TDGVS that is output from each M-bit DAC (e.g., 163) may represent the corresponding $2^M$ (or 8) gamma voltages GV1, GV2, GV3, GV4, GV5, GV6, GV7 and GV8 having non-linear voltage intervals in the 8 divided times, respectively. In the present example of FIG. 6, the 8 gamma voltages GV1, GV2, GV3, GV4, GV5, GV6, GV7 and GV8 of the time-division gamma voltage signal TDGVS may have voltage intervals that are gradually increased in the one horizontal time 1H.

In other embodiments, as illustrated in FIG. 7, the one horizontal time 1H may be equally divided into $2^M$ (or 8 in the present example where M is 3) divided times having the same time period 1H/8, and each time-division gamma voltage signal TDGVS may represent 8 gamma voltages GV1 through GV8 having substantially the same voltage interval in the 8 divided times, respectively. In the present example of FIG. 7, the 8 gamma voltages GV1 through GV8 of the time-division gamma voltage signal TDGVS may be linearly decreased over time in the one horizontal time 1H.

In still other embodiments, as illustrated in FIG. 8, the one horizontal time 1H may be divided into $2^M$ (or 8 in the present example where M is 3) divided times T1 through T8 having different time periods. In the present example of FIG. 8, the 8 divided times T1 through T8 may have time periods that are gradually increased in the one horizontal time 1H. Further, each time-division gamma voltage signal TDGVS may represent the 8 gamma voltages GV1 through GV8 having substantially the same voltage interval in the 8 divided times, respectively.

Since the $2^{N-M}$ M-bit DACs 163, 164, . . . , 166 respectively generate the $2^{N-M}$ time-division gamma voltage signals TDGVS1 through TDGVS2$^{N-M}$, the $2^{N-M}$ time-division gamma voltage signals TDGVS1 through TDGVS2$^{N-M}$ may be respectively or independently adjusted, for example, as illustrated in FIGS. 6, 7, and 8.

Referring to FIG. 1, the $2^{N-M}$ time-division gamma voltage signals TDGVS1 through TDGVS2$^{N-M}$ generated by the first digital-to-analog block 160 may be provided to the plurality of channels CH, or a plurality of (N−M)-bit DACs 172 of the second digital-to-analog block 170 in the plurality of channels CH (see FIG. 12) through the $2^{N-M}$ time-division gamma voltage line groups TDGVLG1 through TDGVLG2$^{N-M}$. Further, as illustrated in FIG. 1, each of the $2^{N-M}$ time-division gamma voltage line groups TDGVLG1 through TDGVLG2$^{N-M}$ may include K time-division gamma voltage lines TDGVL (also denoted as K lines in FIG. 1), where K is greater than 1 and less than or equal to the number of the plurality of channels CH, and the K time-division gamma voltage lines TDGVL of each time-division gamma voltage line group TDGVLG (e.g., TDGVLG1) may transfer the same time-division gamma voltage signal TDGVS (e.g., TDGVS1) of the $2^{N-M}$ time-division gamma voltage signals TDGVS1 through TDGVS2$^{N-M}$.

In the data driver 100 according to an embodiment, the plurality of channels CH may be grouped into K channel groups, and the K time-division gamma voltage lines TDGVL of each time-division gamma voltage line group TDGVLG may be respectively coupled to the K channel groups. Thus, each time-division gamma voltage line TDGVL may be coupled to only a portion of the plurality of channels CH. Accordingly, a load of each time-division gamma voltage line TDGVL and the channels CH coupled thereto may be reduced, and a delay (e.g., an RC delay) of the time-division gamma voltage signal TDGVS transmitted through the time-division gamma voltage line TDGVL may be reduced.

In some embodiments, the plurality of channels CH in the data driver 100 may include K*L channels, where L is an integer greater than 0, and the K*L channels may be grouped into K channel groups such that an (K*I+J)-th channel of the K*L channels is grouped into a J-th channel group of the K channel groups, where I is an integer greater than or equal to 0 and less than L, and J is an integer greater than 0 and less than or equal to K. In this case, the K time-division gamma voltage lines TDGVL may be respectively coupled to the K channel groups such that each of the K time-division gamma voltage lines TDGVL is coupled to the corresponding L channels of the K*L channels.

Referring to FIG. 9, each time-division gamma voltage line group TDGVLG (e.g., TDGVLG1) may include, as the K time-division gamma voltage lines TDGVL, four time-division gamma voltage lines TDGVL. For example, the first time-division gamma voltage line group TDGVLG1 may include four time-division gamma voltage lines TDGVL1_1, TDGVL1_2, TDGVL1_3, and TDGVL1_4 for transferring the first time-division gamma voltage signal TDGVS1, the second time-division gamma voltage line group TDGVLG2 may include four time-division gamma voltage lines TDGVL2_1, TDGVL2_2, TDGVL2_3, and TDGVL2_4 for transferring the second time-division gamma voltage signal TDGVS2, and a ($2^{N-M}$)-th time-division gamma voltage line group TDGVLG2$^{N-M}$ may include four time-division gamma voltage lines TDGVL2$^{N-M}$_1, TDGVL2$^{N-M}$_2, TDGVL2$^{N-M}$_3, and TDGVL2$^{N-M}$_4 for transferring the ($2^{N-M}$)-th time-division gamma voltage signal TDGVS2$^{N-M}$. 4*L channels CH1 through CH4L may be grouped into four channel groups CHG1, CHG2, CHG3, and CHG4. For example, the first, fifth, . . . , and (4L−3)-th channels CH1, CH5, . . . , CH4L-3 may be grouped into a first channel group CHG1, second, sixth, . . . , and (4L−2)-th channels CH2, CH6, . . . , CH4L-2 may be grouped into a second channel group CHG2, third, seventh, . . . , and (4L−1)-th channels CH3, CH7, . . . , CH4L-1 may be grouped into a third channel group CHG3, and fourth, eighth, . . . , and 4L-th channels CH4, CH8, . . . , CH4L may be grouped into a fourth channel group CHG4. The four time-division gamma voltage lines TDGVL (e.g., TDGVL1_1, TDGVL1_2, TDGVL1_3 and TDGVL1_4) of each time-division gamma voltage line group TDGVLG (e.g., TDGVLG1) may be respectively coupled to the four channel groups CHG1, CHG2, CHG3, and CHG4. In the example of FIG. 9, a second digital-to-analog block 170*a* may include 4*L (N−M)-bit DACs 211*a* through 222*a* in the 4*L channels CH1 through CH4L, a first time-division gamma voltage line TDGVL (e.g., TDGVL1_1) of each time-division gamma voltage line group TDGVLG (e.g., TDGVLG1) may be coupled to the (N−M)-bit DACs 211*a*, 215*a*, . . . , 219*a* in the channels CH1, CH5, . . . , CH4L-3 that belong to the first channel group CHG1, a second time-division gamma voltage line TDGVL (e.g., TDGVL1_2) of each time-division gamma voltage line group TDGVLG (e.g., TDGVLG1) may be coupled to the (N−M)-bit DACs 212a, 216a, . . . , 220a in the channels CH2, CH6, . . . , CH4L-2 that belong to the second channel group CHG2, a third time-division gamma voltage line TDGVL (e.g., TDGVL1_3) of each time-division gamma voltage line group TDGVLG (e.g., TDGVLG1) may be coupled to the (N−M)-bit DACs 213a, 217a, . . . , 221a in the channels CH3, CH7, . . . , CH4L-1 that belong to the third channel group CHG3, and a fourth time-division gamma voltage line TDGVL (e.g., TDGVL1_4) of each time-division gamma voltage line group TDGVLG (e.g., TDGVLG1) may be coupled to the (N−M)-bit DACs 214a, 218a, . . . , 222a in the channels CH4, CH8, . . . , CH4L that belong to the fourth channel group CHG4. That is, each time-division gamma voltage line TDGVL (e.g., TDGVL1_1) may be coupled to only L channels (e.g., CH1, CH5, . . . , CH4L−3) among the 4*L channels CH1 through CH4L. In this case, as illustrated in FIG. 10, the time-division gamma voltage line TDGVL for transferring the time-division gamma voltage signal TDGVS is coupled to only the L channels CH1, CH5, . . . , CH4L-3 among the 4*L channels CH1 through CH4L, therefore the time-division gamma voltage signal TDGVS may be affected not by the entire 4*L parasitic capacitors PC1 through PC4L of the 4*L channels CH1 through CH4L, but by only L parasitic capacitors PC1, PC5, . . . , PC4L-3 of the L channels CH1, CH5, . . . , CH4L-3. Accordingly, compared with a case where each time-division gamma voltage line TDGVL is coupled to the entire channels CH1 through CH4L, a load of each time-division gamma voltage line TDGVL and the channels CH1, CH5, . . . , CH4L-3 coupled thereto may be reduced in the data driver 100 according to an embodiment, and a delay (e.g., an RC delay) of the time-division gamma voltage signal TDGVS transmitted through the time-division gamma voltage line TDGVL may be reduced.

In other embodiments, the plurality of channels CH of the data driver 100 may include the K*L channels, and the K*L channels may be grouped into K channel groups such that consecutive L channels of the K*L channels are grouped into the same channel group. Further, the K time-division gamma voltage lines TDGVL may be respectively coupled to the K channel groups. In this case, each of the K time-division gamma voltage lines TDGVL may be coupled to only the corresponding L channels of the K*L channels.

Referring to FIG. 11, each time-division gamma voltage line group TDGVLG (e.g., TDGVLG1) may include, as the K time-division gamma voltage lines TDGVL, four time-division gamma voltage lines TDGVL (e.g., TDGVL1_1, TDGVL1_2, TDGVL1_3, and TDGVL1_4). 4*L channels CH1 through CH4L may be grouped into four channel groups CHG1, CHG2, CHG3, and CHG4. For example, the first through L-th channels CH1 through CHL may be grouped into a first channel group CHG1, (L+1)-th through 2L-th channels CHL+1 through CH2L may be grouped into a second channel group CHG2, (2L+1)-th through 3L-th channels CH2L+1 through CH3L may be grouped into a third channel group CHG3, and (3L+1)-th through 4L-th channels CH3L+1 through CH4L may be grouped into a fourth channel group CHG4. The four time-division gamma voltage lines TDGVL (e.g., TDGVL1_1, TDGVL1_2, TDGVL1_3, and TDGVL1_4) of each time-division gamma voltage line group TDGVLG (e.g., TDGVLG1) may be respectively coupled to the four channel groups CHG1, CHG2, CHG3, and CHG4. In the example of FIG. 11, a second digital-to-analog block 170b may include 4*L (N−M)-bit DACs 211b through 218b in the 4*L channels CH1 through CH4L, a first time-division gamma voltage line TDGVL (e.g., TDGVL1_1) of each time-division gamma voltage line group TDGVLG (e.g., TDGVLG1) may be coupled to the (N−M)-bit DACs 211b, . . . , 212b in the channels CH1 through CHL that belong to the first channel group CHG1, a second time-division gamma voltage line TDGVL (e.g., TDGVL1_2) of each time-division gamma voltage line group TDGVLG (e.g., TDGVLG1) may be coupled to the (N−M)-bit DACs 213b, . . . , 214b in the channels CHL+1 through CH2L that belong to the second channel group CHG2, a third time-division gamma voltage line TDGVL (e.g., TDGVL1_3) of each time-division gamma voltage line group TDGVLG (e.g., TDGVLG1) may be coupled to the (N−M)-bit DACs 215b, . . . , 216b in the channels CH2L+1 through CH3L that belong to the third channel group CHG3, and a fourth time-division gamma voltage line TDGVL (e.g., TDGVL1_4) of each time-division gamma voltage line group TDGVLG (e.g., TDGVLG1) may be coupled to the (N−M)-bit DACs 217b, . . . , 218b in the channels CH3L+1 through CH4L that belong to the fourth channel group CHG4. That is, each time-division gamma voltage line TDGVL (e.g., TDGVL1_1) may be coupled to only L channels (e.g., CH1 through CHL) among the 4*L channels CH1 through CH4L. Accordingly, a load of each time-division gamma voltage line TDGVL and the channels CH1 through CHL coupled thereto may be reduced, and a delay (e.g., an RC delay) of the time-division gamma voltage signal TDGVS (e.g., TDGVS1) transmitted through the time-division gamma voltage line TDGVL (e.g., TDGVL1_1) may be reduced.

Although FIGS. 9 and 11 illustrate examples where each time-division gamma voltage line group TDGVLG includes four time-division gamma voltage lines TDGVL, the number of the time-division gamma voltage lines TDGVL included in each time-division gamma voltage line group TDGVLG is not limited to the examples of FIGS. 9 and 11. Further, FIGS. 9 and 11 illustrate examples of connecting the time-division gamma voltage lines TDGVL and the plurality of channels CH, the connection relationships between the time-division gamma voltage lines TDGVL and the plurality of channels CH are not limited the examples of FIGS. 9 and 11.

Referring again to FIG. 1, the second digital-to-analog block 170 may receive the upper (N−M) bits of each pixel data PDAT (through the level shifter block 140) from the holding latch block 130, may receive the $2^{N-M}$ time-division gamma voltage signals TDGVS1 through TDGVS$2^{N-M}$ from the first digital-to-analog block 160 through the $2^{N-M}$ time-division gamma voltage line groups TDGVLG1 through TDGVLG$2^{N-M}$, and may select one time-division gamma voltage signal STDGVS among the $2^{N-M}$ time-division gamma voltage signals TDGVS1 through TDGVS$2^{N-M}$ according to the upper (N−M) bits of the N bits of the corresponding pixel data PDAT in each channel CH. For example, in a case where N is 10, and M is 4, the second digital-to-analog block 170 may select one time-division gamma voltage signal STDGVS among 64 time-division gamma voltage signals TDGVS1 through TDGVS$2^{N-M}$ according to the upper 6 bits of the pixel data PDAT in each channel CH.

In some embodiments, as illustrated in FIG. 12, the second digital-to-analog block 170 may include the plurality of (N−M)-bit DACs 172 respectively corresponding to the plurality of channels CH. That is, the number of the plurality of (N−M)-bit DACs 172 in the second digital-to-analog block 170 may correspond to the number of the plurality of channels CH. The (N−M)-bit DAC 172 in each channel CH may select one time-division gamma voltage signal STDGVS among the $2^{N-M}$ time-division gamma voltage signals TDGVS1 through TDGVS2$^{N-M}$ according to the upper (N−M) bits of the pixel data PDAT. To perform this operation, the (N−M)-bit DAC 172 in each channel CH may include a decoder 174 and $2^{N-M}$ switches SW1 through SW2$^{N-M}$. The decoder 174 may generate $2^{N-M}$ switching signals SWS1 through SWS2$^{N-M}$ based on the upper (N−M) bits of the pixel data PDAT. The $2^{N-M}$ switches SW1 through SW2$^{N-M}$ may selectively output the $2^{N-M}$ time-division gamma voltage signals TDGVS1 through TDGVS2$^{N-M}$ in response to the $2^{N-M}$ switching signals SWS1 through SWS2$^{N-M}$, respectively. One of the $2^{N-M}$ switching signals SWS1 through SWS2$^{N-M}$ may have an on-level according to the upper (N−M) bits of the pixel data PDAT, one of the $2^{N-M}$ switches SW1 through SW2$^{N-M}$ may be turned on in response to the one switching signal having the on-level, and thus one of the $2^{N-M}$ time-division gamma voltage signals TDGVS1 through TDGVS2$^{N-M}$ may be output as a selected time-division gamma voltage signal STDGVS. Although FIG. 12 illustrates an example where the second digital-to-analog block 170 is implemented with a decoder-type DAC including the decoder 174, according to an embodiment, the second digital-to-analog block 170 may be implemented with a read-only memory (ROM) type DAC, a tree type DAC, or any other type DAC.

Referring again to FIG. 1, the time-division gamma voltage select block 180 may receive the lower M bits of each pixel data PDAT from the holding latch block 130 through the level shifter block 140, may receive the selected time-division gamma voltage signal STDGVS in each channel CH from the second digital-to-analog block 170, and may select one gamma voltage SGV among the $2^M$ gamma voltages (e.g., GV1 through GV2$^M$) represented by the selected time-division gamma voltage signal STDGVS according to the lower M bits of the pixel data PDAT in each channel CH. For example, in a case where N is 10, and M is 4, the time-division gamma voltage select block 180 may select one gamma voltage SGV among 16 gamma voltages (e.g., GV1 through GV2$^M$) represented by the selected time-division gamma voltage signal STDGVS according to the lower 4 bits of the pixel data PDAT in each channel CH.

In some embodiments, as illustrated in FIG. 13, the time-division gamma voltage select block 180 may include a plurality of switching signal generators 182 respectively corresponding to the plurality of channels CH, and a plurality of time-division gamma voltage select switches TDSW respectively corresponding to the plurality of channels CH. That is, the number of the plurality of switching signal generators 182 and the number of the plurality of time-division gamma voltage select switches TDSW may correspond to the number of the plurality of channels CH. The switching signal generator 182 in each channel CH may generate a time-division switching signal TDSS having an active level (e.g., a high level) during a divided time corresponding to the lower M bits of the pixel data PDAT among the $2^M$ divided times of the one horizontal time 1H. For example, the switching signal generator 182 may receive the M-clock signal MCLK having the $2^M$ clocks during the one horizontal time 1H from the M-clock generator 161 or another clock generator, may count the clocks of the M-clock signal MCLK, and may generate the time-division switching signal TDSS having the active level while the number of the counted clocks corresponds to a value of the lower M bits of the pixel data PDAT. In the example illustrated in FIG. 14 where M is 3, the one horizontal time 1H is divided into 8 divided times, and the lower 3 bits of the pixel data PDAT have a value of 5, the switching signal generator 182 may generate the time-division switching signal TDSS having the active level during a fifth divided time (e.g., from a time point of 4H/8 to a time point of 5H/8) among the 8 divided times in the one horizontal time 1H. The time-division gamma voltage select switch TDSW may select the one gamma voltage SGV among the $2^M$ gamma voltages (e.g., GV1 through GV2$^M$) in response to the time-division switching signal TDSS having the active level. In the example illustrated in FIG. 14 where the selected time-division gamma voltage signal STDGVS represents the first through eighth gamma voltages GV1 through GV8 in the 8 divided times, respectively, and the time-division switching signal TDSS has the active level during the fifth divided time (e.g., from the time point of 4H/8 to the time point of 5H/8) among the 8 divided times, the time-division gamma voltage select switch TDSW may select the fifth gamma voltage GV5 among the first through eighth gamma voltages GV1 through GV8 in the fifth divided time.

Referring again to FIG. 1, the output buffer block 190 may receive the selected gamma voltage SGV in each channel CH from the time-division gamma voltage select block 180, and may output, as the data voltage VD, the selected gamma voltage SGV in each channel CH. In some embodiments, the output buffer block 190 may include a plurality of output buffers respectively corresponding to the plurality of channels CH.

As described above, the data driver 100 may select one of the $2^{N-M}$ time-division gamma voltage signals TDGVS1 through TDGVS2$^{N-M}$ according to the upper (N−M) bits of the pixel data PDAT in each channel CH using the second digital-to-analog block 170, and may select one of the $2^M$ gamma voltages (e.g., GV1 through GV2$^M$) represented by the selected time-division gamma voltage signal STDGVS according to the lower M bits of the pixel data PDAT in each channel CH using the first digital-to-analog block 160 and the time-division gamma voltage select block 180. Accordingly, a size and power consumption of the data driver 100 may be reduced. Further, in the data driver 100, each time-division gamma voltage signal TDGVS (e.g., TDGVS1) may be transferred to the plurality of channels CH through the K time-division gamma voltage lines TDGVL, and each time-division gamma voltage line TDGVL may be coupled to only a corresponding portion of the plurality of channels CH. Accordingly, a delay (e.g., an RC delay) of each time-division gamma voltage signal TDGVS (e.g., TDGVS1) may be reduced, and the time-division gamma voltage signal TDGVS (e.g., TDGVS1) may be accurately transferred to the plurality of channels CH.

Figure 15:
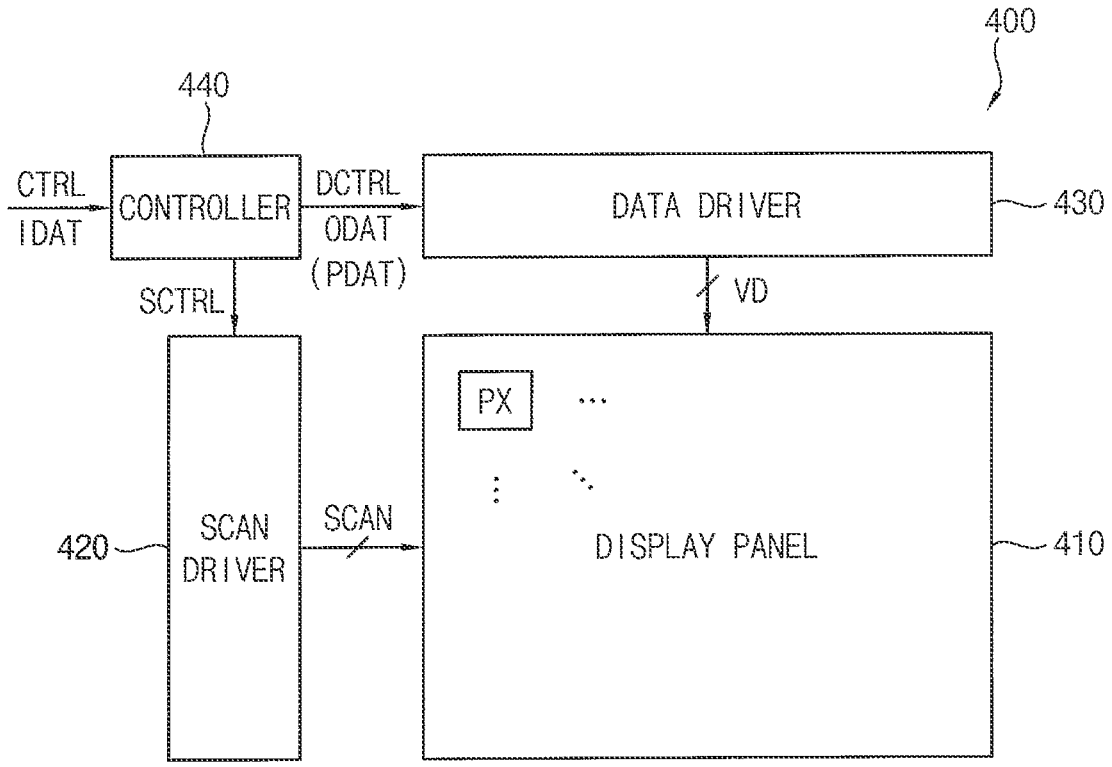
FIG. 15 is a block diagram of a display device including a data driver according to an embodiment.

FIG. 15 is a block diagram of a display device including a data driver according to an embodiment, FIG. 16 is a circuit diagram of a pixel included in a display device according to an embodiment, and FIG. 17 is a circuit diagram of another example of a pixel included in a display device according to an embodiment.

Referring to FIG. 15, a display device 400 may include a display panel 410 that includes a plurality of pixels PX, a scan driver 420 that provides scan signals SCAN to the plurality of pixels PX, a data driver 430 that provides data voltages VD to the plurality of pixels PX, and a controller 440 that controls the scan driver 420 and the data driver 430.

The display panel 410 may include scan lines, data lines, and the plurality of pixels PX coupled to the scan lines and the data lines. In some embodiments, the display panel 410 may be an OLED display panel. In this case, each pixel PX may include at least two transistors, at least one capacitor, and an organic light emitting diode (OLED). Referring to FIG. 16, each pixel PX may include a switching transistor PT2 that transfers the data voltage VD in response to the scan signal SCAN, a storage capacitor CST that stores the data voltage VD transferred by the switching transistor PT2, a driving transistor PT1 that provides a driving current from a line of a first power supply voltage ELVDD to a line of a second power supply voltage ELVSS based on the data voltage VD stored in the storage capacitor CST, and an organic light emitting diode EL that emits light based on the driving current provided by the driving transistor PT1. In some embodiments, as illustrated in FIG. 16, the driving transistor PT1 and the switching transistor PT2 may be implemented with PMOS transistors. In other embodiments, as illustrated in FIG. 17, the driving transistor NT1 and the switching transistor NT2 may be implemented with NMOS transistors. In still other embodiments, each pixel PX may include at least one PMOS transistor and at least one NMOS transistor. In other embodiments, the display panel 410 may be a liquid crystal display (LCD) panel. In this case, each pixel PX may include a switching transistor and a liquid crystal capacitor coupled to the switching transistor. However, the display panel 410 may not be limited to the OLED panel and the LCD panel, and it may be any suitable display panel to display an image.

The scan driver 420 may generate the scan signals SCAN based on a scan control signal SCTRL received from the controller 440, and may sequentially provide the scan signals SCAN to the plurality of pixels PX on a row-by-row basis through the scan lines. In some embodiments, the scan control signal SCTRL may include, but is not limited to, a scan start signal (e.g., the start signal STS of FIG. 1), a scan clock signal (e.g., the clock signal CLK of FIG. 1), etc. In some embodiments, the scan driver 420 may be integrated or formed in a peripheral portion of the display panel 410. In other embodiments, the scan driver 420 may be implemented in a form of an integrated circuit (IC).

The data driver 430 may generate the data voltages VD based on output image data ODAT (or the pixel data PDAT) and a data control signal DCTRL received from the controller 440, and may provide the data voltages VD to the plurality of pixels PX through the data lines. In some embodiments, the data control signal DCTRL may include, but is not limited to, the start signal STS, the clock signal CLK, the load signal LOAD of in FIG. 1. In some embodiments, the data driver 430 and the controller 440 may be implemented in a single integrated circuit referred to as a timing controller embedded data driver (TED). In other embodiments, the data driver 430 and the controller 440 may be implemented in separate integrated circuits.

In some embodiments, the data driver 430 may be the data driver 100 of FIG. 1. The data driver 430 may select one of the $2^{N-M}$ time-division gamma voltage signals TDGVS according to the upper (N−M) bits of the pixel data PDAT in each channel CH using the second digital-to-analog block 170, and may select one of $2^{M}$ gamma voltages represented by the selected time-division gamma voltage signal STDGVS according to the lower M bits of the pixel data PDAT in each channel CH using the first digital-to-analog block 160 and the time-division gamma voltage select block 180. Accordingly, a size and power consumption of the data driver 430 may be reduced. Further, in the data driver 430, each time-division gamma voltage signal TDGVS may be transferred to a plurality of channels CH through the K time-division gamma voltage lines TDGVL, and each time-division gamma voltage line TDGVL may be coupled to only a corresponding portion of the plurality of channels CH. Accordingly, a delay (e.g., an RC delay) of each time-division gamma voltage signal TDGVS may be reduced, and the time-division gamma voltage signal TDGVS may be accurately transferred to the plurality of channels CH.

The controller 440 (e.g., a timing controller (TCON)) may receive input image data IDAT and a control signal CTRL from an external host (e.g., a graphic processing unit (GPU), a graphic card, etc.). For example, the input image data IDAT may be, but is not limited to, RGB image data including red image data, green image data, and blue image data. Further, the control signal CTRL may include, but is not limited to, a data enable signal, a master clock signal, etc. The controller 440 may generate the output image data ODAT, the data control signal DCTRL, and the scan control signal SCTRL based on the input image data IDAT and the control signal CTRL. The controller 440 may control an operation of the scan driver 420 by providing the scan control signal SCTRL to the scan driver 420, and may control an operation of the data driver 430 by providing the output image data ODAT and the data control signal DCTRL to the data driver 430.

As described above, in the display device 400 according to an embodiment, the data driver 430 may perform an (N−M)-bit gamma voltage select operation in a spatial division scheme according to the upper (N−M) bits of the pixel data PDAT using the second digital-to-analog block 170, and may perform an M-bit gamma voltage select operation in a temporal division scheme according to the lower M bits of the pixel data PDAT using the first digital-to-analog block 160 and the time-division gamma voltage select block 180. Accordingly, the size and the power consumption of the data driver 430 may be reduced. Further, in the data driver 430, each time-division gamma voltage signal TDGVS may be transferred to the plurality of channels CH through the K time-division gamma voltage lines TDGVL. Accordingly, the delay of each time-division gamma voltage signal TDGVS may be reduced, and the time-division gamma voltage signal TDGVS may be accurately transferred to the plurality of channels CH.

Figure 18:
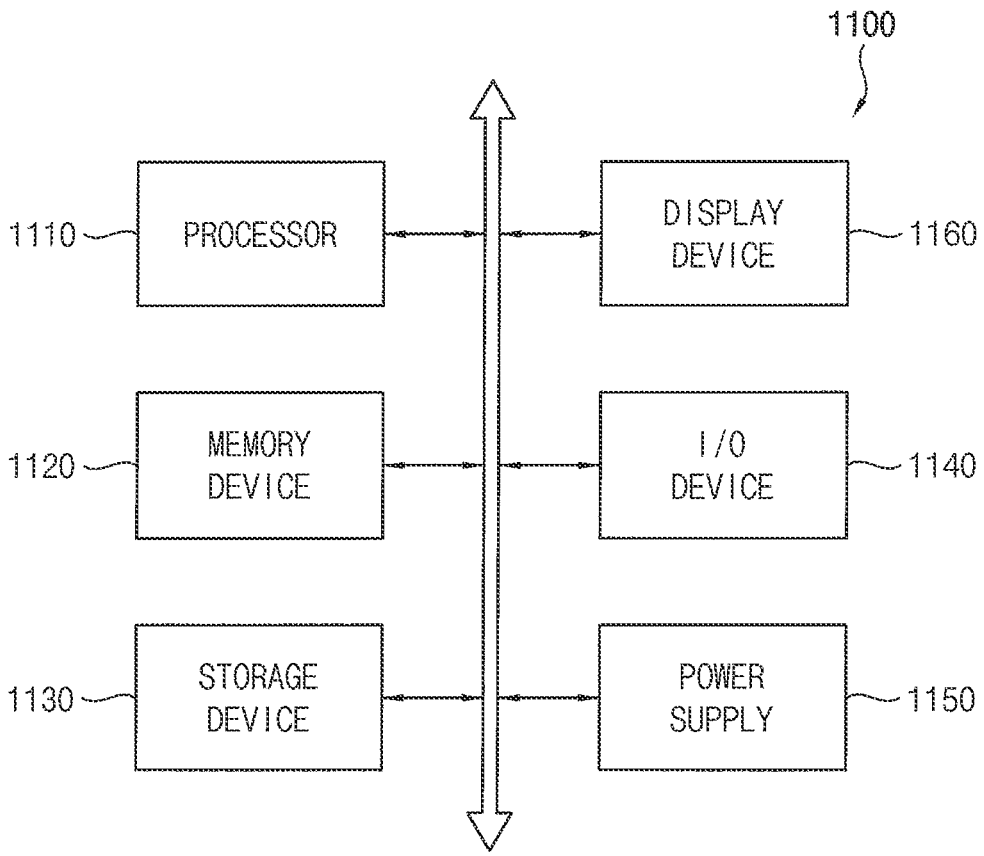
FIG. 18 is a block diagram of an electronic device including a display device according to an embodiment.

FIG. 18 is a block diagram of an electronic device including a display device according to an embodiment.

Referring to FIG. 18, an electronic device 1100 may include a processor 1110, a memory device 1120, a storage device 1130, an input/output (I/O) device 1140, a power supply 1150, and a display device 1160. The electronic device 1100 may further include a plurality of ports for communicating with various peripheral devices including, but not limited to, a video card, a sound card, a memory card, a universal serial bus (USB) device, other electric devices, etc.

The processor 1110 may perform various computing functions or tasks. The processor 1110 may be an application processor (AP), a microprocessor, a central processing unit (CPU), etc. The processor 1110 may be coupled to other components of the electronic device 1100 via an address bus, a control bus, a data bus, etc. Further, in some embodiments, the processor 1110 may be further coupled to an extended bus such as a peripheral component interconnection (PC1) bus.

The memory device 1120 may store data for operating the electronic device 1100. For example, the memory device 1120 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc., and/or at least one volatile memory device such as a dynamic random access memory (DRAM) device, a static random access memory (SRAM) device, a mobile dynamic random access memory (mobile DRAM) device, etc.

The storage device 1130 may be a solid state drive (SSD) device, a hard disk drive (HDD) device, a CD-ROM device, etc. The I/O device 1140 may be an input device such as a keyboard, a keypad, a mouse, a touch screen, etc., and an output device such as a printer, a speaker, etc. The power supply 1150 may supply power for operating the electronic device 1100. The display device 1160 may be coupled to other components through the buses or other communication links.

The display device 1160 may be the display device 400 of FIG. 15. The display device 1160 include a data driver that performs an (N−M)-bit gamma voltage select operation in a spatial division scheme according to the upper (N−M) bits of the pixel data PDAT using the second digital-to-analog block 170, and may perform an M-bit gamma voltage select operation in a temporal division scheme according to the lower M bits of the pixel data PDAT using the first digital-to-analog block 160 and the time-division gamma voltage select block 180. Accordingly, a size and power consumption of the display device 1160 may be reduced. Further, in the display device 1160, each time-division gamma voltage signal TDGVS may be transferred to a plurality of channels CH through K time-division gamma voltage lines TDGVL. Accordingly, a delay of each time-division gamma voltage signal TDGVS may be reduced, and the time-division gamma voltage signal TDGVS may be accurately transferred to the plurality of channels CH.

According to an embodiment, the electronic device 1100 may be any electronic device including the display device 1160, such as a digital television, a three-dimensional (3D) television, a personal computer (PC), a home appliance, a laptop computer, a cellular phone, a smart phone, a tablet computer, a wearable device, a personal digital assistant (PDA), a portable multimedia player (PMP), a digital camera, a music player, a portable game console, a navigation system, etc.

The foregoing is illustrative of embodiments of the present disclosure and is not to be construed as limiting thereof. Although some embodiments have been described, those skilled in the art will readily appreciate that deviations and/or modifications are possible in the embodiments without materially departing from the novel teachings and advantages of the present inventive concept. Accordingly, such deviations and/or modifications are intended to be included within the scope of the present inventive concept of the present disclosure including the claims. Therefore, it is to be understood that the foregoing is illustrative of various embodiments and is not to be construed as limited to the specific embodiments disclosed, and that deviations and/or modifications to the disclosed embodiments, as well as other embodiments, are intended to be included within the scope of the present disclosure including the appended claims.

What is claimed is:

1. A data driver outputting a plurality of data voltages to a plurality of pixels through a plurality of channels, the data driver comprising:

a gamma voltage generator configured to generate $2^N$ gamma voltages, where N is an integer greater than one corresponding to a number of data bits of each pixel data among a plurality of pixel data received by the data driver;

a first digital-to-analog block configured to group the $2^N$ gamma voltages into $2^{N-M}$ gamma voltage groups such that each gamma voltage group of the $2^{N-M}$ gamma voltage groups includes $2^M$ gamma voltages among the $2^N$ gamma voltages, where M is an integer greater than zero and less than N, and to generate $2^{N-M}$ time-division gamma voltage signals respectively corresponding to the $2^{N-M}$ gamma voltage groups, each time-division gamma voltage signal of the $2^{N-M}$ time-division gamma voltage signals representing the $2^M$ gamma voltages by dividing one horizontal time;

$2^{N-M}$ time-division gamma voltage line groups for transferring the $2^{N-M}$ time-division gamma voltage signals, each time-division gamma voltage line group of the $2^{N-M}$ time-division gamma voltage line groups including K time-division gamma voltage lines, where K is greater than one and less than or equal to a number of the plurality of channels;

a second digital-to-analog block configured to receive the $2^{N-M}$ time-division gamma voltage signals through the $2^{N-M}$ time-division gamma voltage line groups, and to select a time-division gamma voltage signal among the $2^{N-M}$ time-division gamma voltage signals according to upper (N−M) bits of the N bits of a corresponding one of the plurality of pixel data in each of the plurality of channels;

a time-division gamma voltage select block configured to select a gamma voltage among the $2^M$ gamma voltages represented by the time-division gamma voltage signal selected by the second digital-to-analog block according to lower M bits of the N bits of the corresponding one of the plurality of pixel data in each of the plurality of channels; and an output buffer block configured to output, as a data voltage among the plurality of data voltages, the gamma voltage in each of the plurality of channels.

2. The data driver of claim 1, wherein the plurality of channels is grouped into K channel groups, and wherein the K time-division gamma voltage lines are respectively coupled to the K channel groups.

3. The data driver of claim 1, wherein the plurality of channels includes K*L channels, where L is an integer greater than zero, wherein the K*L channels are grouped into K channel groups such that an (K*I+J)-th channel of the K*L channels is grouped into a J-th channel group of the K channel groups, where I is an integer greater than or equal to zero and less than L, and J is an integer greater than zero and less than or equal to K, and wherein the K time-division gamma voltage lines are respectively coupled to the K channel groups such that each of the K time-division gamma voltage lines is coupled to L channels of the K*L channels.

4. The data driver of claim 1, wherein the K time-division gamma voltage lines are four time-division gamma voltage lines, wherein the plurality of channels includes 4*L channels, where L is an integer greater than zero, wherein the 4*L channels are grouped into four channel groups such that an (4*I+J)-th channel of the 4*L channels is grouped into a J-th channel group of the four channel groups, where I is an integer greater than or equal to zero and less than L, and J is an integer greater than zero and less than or equal to four, and wherein the four time-division gamma voltage lines are respectively coupled to the four channel groups such that each of the four time-division gamma voltage lines is coupled to L channels of the 4*L channels.

5. The data driver of claim 1, wherein the plurality of channels includes K*L channels, where L is an integer greater than zero, wherein the K*L channels are grouped into K channel groups such that consecutive L channels of the K*L channels are grouped into a channel group among the K channel groups, and wherein the K time-division gamma voltage lines are respectively coupled to the K channel groups such that each of the K time-division gamma voltage lines is coupled to the consecutive L channels of the K*L channels.

6. The data driver of claim 1, wherein the K time-division gamma voltage lines are four time-division gamma voltage lines, wherein the plurality of channels includes 4*L channels, where L is an integer greater than zero, wherein first through L-th channels of the 4*L channels are grouped into a first channel group, (L+1)-th through 2L-th channels of the 4*L channels are grouped into a second channel group, (2L+1)-th through 3L-th channels of the 4*L channels are grouped into a third channel group, and (3L+1)-th through 4L-th channels of the 4*L channels are grouped into a fourth channel group, and wherein the four time-division gamma voltage lines are respectively coupled to the first channel group, the second channel group, the third channel group, and the fourth channel group such that each of the four time-division gamma voltage lines is coupled to L channels of the 4*L channels.

7. The data driver of claim 1, wherein the one horizontal time is equally divided into $2^M$ divided times having a same time period, and wherein each time-division gamma voltage signal represents the $2^M$ gamma voltages having non-linear voltage intervals in the $2^M$ divided times, respectively.

8. The data driver of claim 1, wherein the one horizontal time is equally divided into $2^M$ divided times having a same time period, and wherein each time-division gamma voltage signal represents the $2^M$ gamma voltages having a same voltage interval in the $2^M$ divided times, respectively.

9. The data driver of claim 1, wherein the one horizontal time is divided into $2^M$ divided times having different time periods, and wherein each time-division gamma voltage signal represents the $2^M$ gamma voltages having a same voltage interval in the $2^M$ divided times, respectively.

10. The data driver of claim 1, wherein the gamma voltage generator comprises:

$2^N$+1 resistors coupled in series between a first line of a high voltage and a second line of a low voltage, and configured to generate the $2^N$ gamma voltages by dividing a voltage between the high voltage and the low voltage.

11. The data driver of claim 1, wherein the $2^N$ gamma voltages generated by the gamma voltage generator are gradually decreased from a first gamma voltage to a ($2^N$)-th gamma voltage.

12. The data driver of claim 1, wherein the $2^N$ gamma voltages generated by the gamma voltage generator are gradually increased from a first gamma voltage to a ($2^N$)-th gamma voltage.

13. The data driver of claim 1, wherein a first voltage interval between the $2^N$ gamma voltages in a low gray region is less than a second voltage interval between the $2^N$ gamma voltages in a high gray region.

14. The data driver of claim 1, wherein the first digital-to-analog block includes:

a clock generator configured to generate a clock signal having $2^M$ clocks during the one horizontal time;

a bit counter configured to generate a count signal representing one to $2^M$ in response to the clock signal; and $2^{N-M}$ M-bit digital-to-analog converters configured to output the $2^{N-M}$ time-division gamma voltage signals, respectively, each M-bit digital-to-analog converter of the $2^{N-M}$ M-bit digital-to-analog converters configured to sequentially output, as a time-division gamma voltage signal of the $2^{N-M}$ time-division gamma voltage signals, the $2^M$ gamma voltages in response to the count signal.

15. The data driver of claim 1, wherein the second digital-to-analog block comprises:

a plurality of (N−M)-bit digital-to-analog converters respectively corresponding to the plurality of channels, each (N−M)-bit digital-to-analog converter of the plurality of (N−M)-bit digital-to-analog converters configured to select the time-division gamma voltage signal among the $2^{N-M}$ time-division gamma voltage signals according to the upper (N−M) bits of the corresponding one of the plurality of pixel data.

16. The data driver of claim 15, wherein each of the plurality of (N−M)-bit digital-to-analog converters comprises:

a decoder configured to generate $2^{N-M}$ switching signals based on the upper (N−M) bits of the corresponding one of the plurality of pixel data; and $2^{N-M}$ switches configured to selectively output the $2^{N-M}$ time-division gamma voltage signals in response to the $2^{N-M}$ switching signals.

17. The data driver of claim 1, wherein the time-division gamma voltage select block comprises:

a plurality of switching signal generators respectively corresponding to the plurality of channels, each switching signal generator of the plurality of switching signal generators configured to generate a time-division switching signal having an active level during a divided time corresponding to the lower M bits of the corresponding one of the plurality of pixel data among $2^M$ divided times of the one horizontal time; and a plurality of time-division gamma voltage select switches respectively corresponding to the plurality of channels, each time-division gamma voltage select switch of the plurality of time-division gamma voltage select switches configured to select the gamma voltage among the $2^M$ gamma voltages in response to the time-division switching signal having the active level.

18. The data driver of claim 1, further comprising:

a shift register block configured to sequentially generate sampling signals in response to a start signal and a clock signal;

a sampling latch block configured to sequentially sample the plurality of pixel data in response to the sampling signals; and a holding latch block configured to store the plurality of pixel data sampled by the sampling latch block in response to a load signal.

19. The data driver of claim 18, wherein the upper (N−M) bits of the N bits of each of the plurality of pixel data that is output from the holding latch block are provided to the second digital-to-analog block, and wherein the lower M bits of the N bits of each of the plurality of pixel data that is output from the holding latch block are provided to the time-division gamma voltage select block.

20. A display device comprising:

a display panel including a plurality of pixels;

a data driver configured to receive a plurality of pixel data each having N bits, and to output a plurality of data voltages corresponding to the plurality of pixel data to the plurality of pixels through a plurality of channels, where N is an integer greater than one; and a controller configured to provide the plurality of pixel data to the data driver, wherein the data driver comprises:

a gamma voltage generator configured to generate $2^N$ gamma voltages;

a first digital-to-analog block configured to group the $2^N$ gamma voltages into $2^{N-M}$ gamma voltage groups such that each gamma voltage group of the $2^{N-M}$ gamma voltage groups includes $2^M$ gamma voltages among the $2^N$ gamma voltages, where M is an integer greater than zero and less than N, and to generate $2^{N-M}$ time-division gamma voltage signals respectively corresponding to the $2^{N-M}$ gamma voltage groups, each time-division gamma voltage signal of the $2^{N-M}$ time-division gamma voltage signals representing the $2^M$ gamma voltages by dividing one horizontal time;

$2^{N-M}$ time-division gamma voltage line groups for transferring the $2^{N-M}$ time-division gamma voltage signals, each time-division gamma voltage line group of the $2^{N-M}$ time-division gamma voltage line groups including K time-division gamma voltage lines, where K is greater than one and less than or equal to a number of the plurality of channels;

a second digital-to-analog block configured to receive the $2^{N-M}$ time-division gamma voltage signals through the $2^{N-M}$ time-division gamma voltage line groups, and to select a time-division gamma voltage signal among the $2^{N-M}$ time-division gamma voltage signals according to upper (N−M) bits of the N bits of a corresponding one of the plurality of pixel data in each of the plurality of channels;

a time-division gamma voltage select block configured to select a gamma voltage among the $2^M$ gamma voltages represented by the time-division gamma voltage signal selected by the second digital-to-analog block according to lower M bits of the N bits of the corresponding one of the plurality of pixel data in each of the plurality of channels; and an output buffer block configured to output, as a data voltage among the plurality of data voltages, the gamma voltage in each of the plurality of channels.

* * * * *